United States Patent [19]

Akers

[11] Patent Number: 4,555,812

[45] Date of Patent: Dec. 3, 1985

[54] LIGHT WEIGHT PACK FOR ATTACHING TO THE CLOTHES OF A HIKER

[76] Inventor: James L. Akers, 18624 140th SE., Renton, Wash. 98055

[21] Appl. No.: 187,491

[22] Filed: Sep. 15, 1980

[51] Int. Cl.[4] ..... A41D 1/00

[52] U.S. Cl. ..... 2/94

[58] Field of Search ..... 2/94, 85, 93, 69

[56] References Cited

U.S. PATENT DOCUMENTS

| | | | |
|---|---|---|---|
| 2,620,479 | 12/1952 | Buck | 2/94 |
| 2,970,316 | 2/1961 | Silin | 2/94 |
| 3,529,307 | 9/1970 | Belson et al. | 2/94 |
| 4,041,549 | 8/1977 | Atkinson | 2/94 |
| 4,068,314 | 1/1978 | Yellen et al. | 2/94 |
| 4,272,852 | 6/1981 | Bell | 2/94 |
| 4,302,847 | 12/1981 | Miles | 2/94 |

*Primary Examiner*—Doris L. Troutman

*Attorney, Agent, or Firm*—Thomas W. Secrest

[57] ABSTRACT

This invention is directed to a method and an apparatus for converting, preferably, outdoor clothes to a pack by means so that a hiker can carry small and medium sized items. This invention, in many instances, eliminates the need for using a pack board by a hiker for carrying items. For example, there can be attached to suspenders, to a jacket or to a shirt a first attaching means. A pocket or a bag or a pack has a second attaching means. The second attaching means can be, removably, attached to the first attaching means so that the hiker has a pocket or bag or a plurality of pockets and bags attached to suspenders, jacket or a shirt. Further, this invention is directed to a bag, such as a fishing creel, whereby the creel can be attached to the clothes of an individual and carried in that manner.

20 Claims, 54 Drawing Figures

LIGHT WEIGHT PACK FOR ATTACHING TO THE CLOTHES OF A HIKER

A BRIEF DESCRIPTION OF THE INVENTION

Often, a person in taking a hike will have a back pack such as a pack board. In place of a pack board a person can use clothes, viz., suspenders, shirt or jacket, as a basic support. Then, there can be attached to the basic support a first attaching means.

Then, a pocket or a plurality of pockets or bags, each having a second attaching means, can be, removably, attached to the first attaching means on the suspenders, jacket or shirt.

The pockets for attaching to the suspenders can be small pockets. The small pockets can be used for carrying fishing accessories such as fish hooks, leader and some line. Also, the small pockets can be used for carrying matches, a knife and the like.

The bag can be of a sufficient size to carry a reel of fish line, a map, some food, photographic film for a camera and the like.

Further, the bag can be a fishing creel for holding and carrying fish.

The pockets and the bag are light in weight. Therefore, a hiker having the pockets and the bag is not burdened by a packboard or a frame of useless weight. In addition, the pockets or bag can be of cloth and easily folded and made into a small volume for easy storage.

THE DRAWINGS

Figure 12:
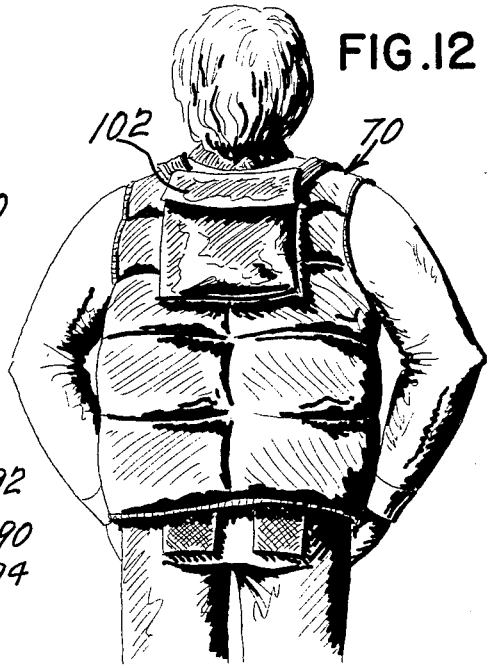
Figure 11:
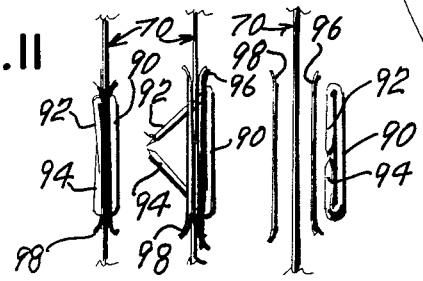
Figure 13:
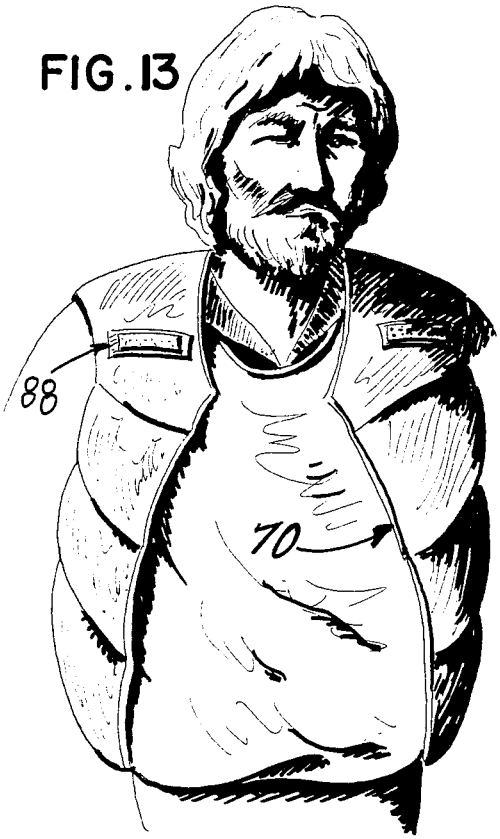
Figure 15:
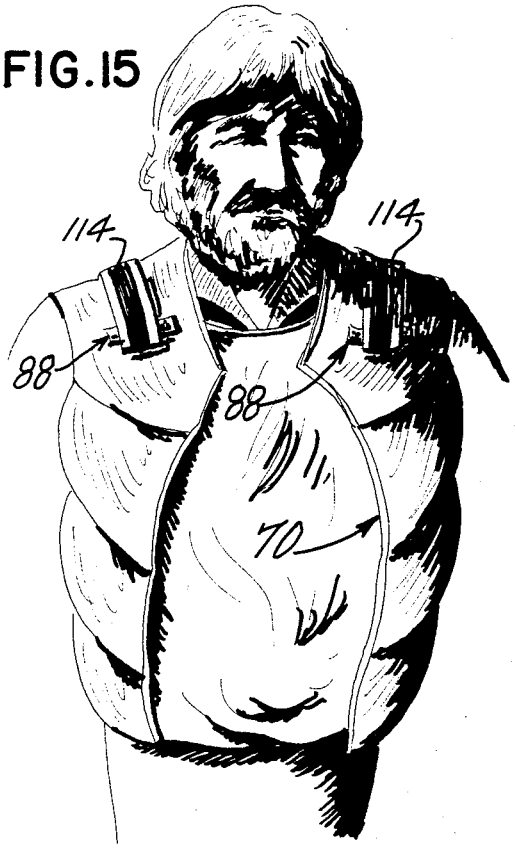
Figure 14:
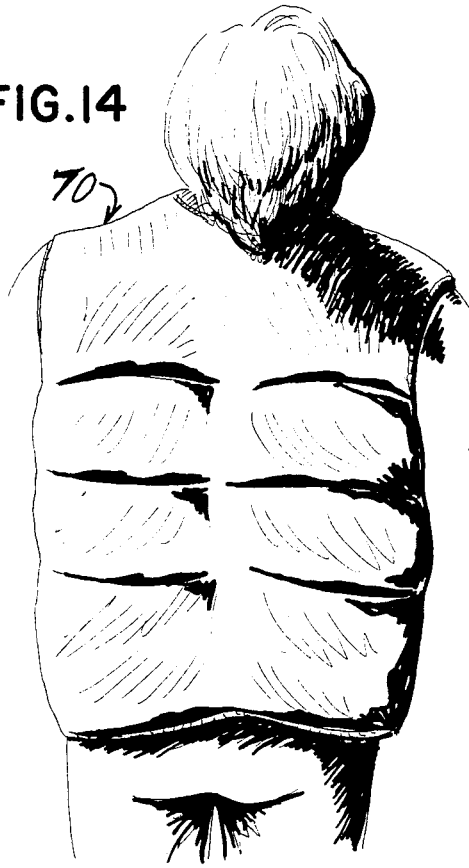
Figure 16:
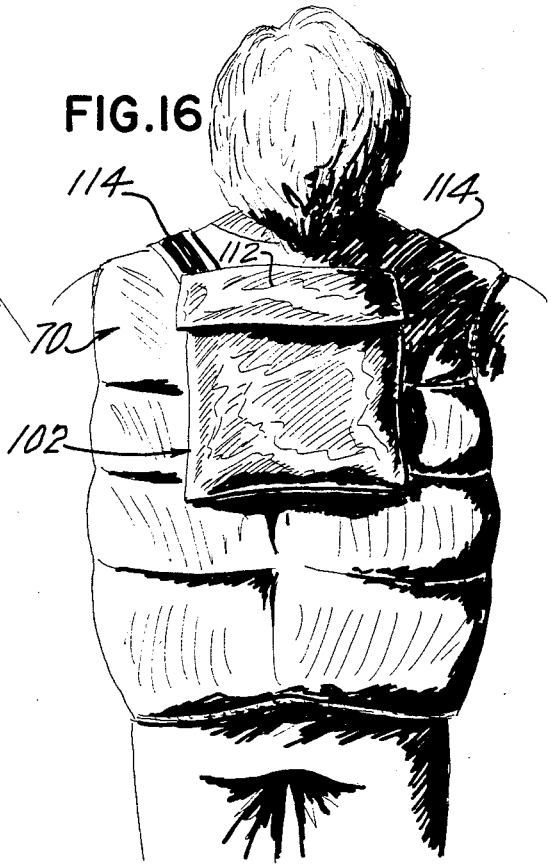
Figure 17:
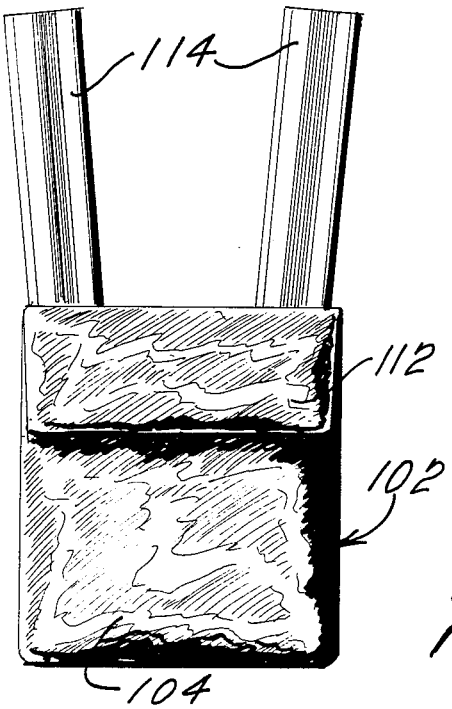
Figure 18:
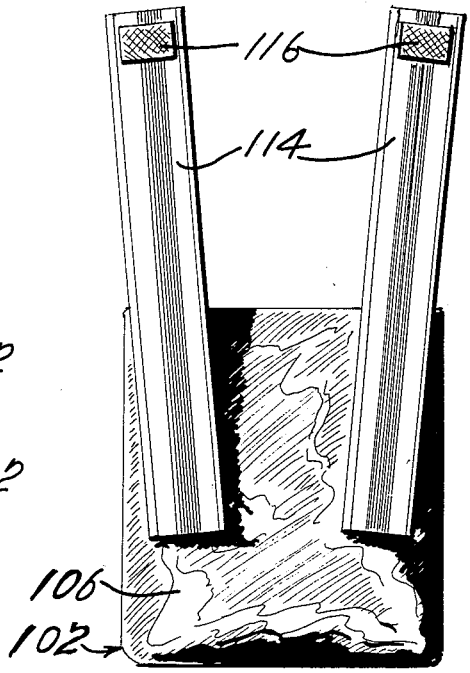
Figure 19:
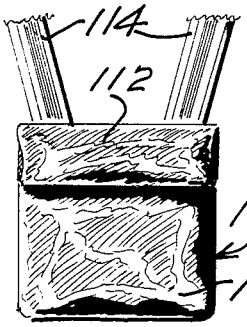
Figure 20:
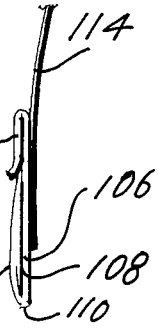
Figure 21:
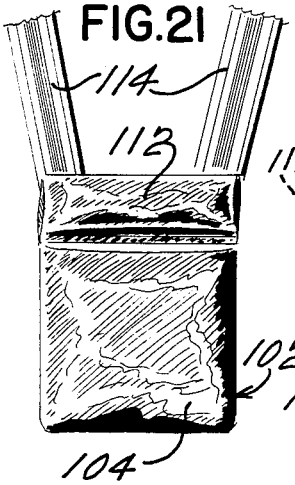
Figure 22:
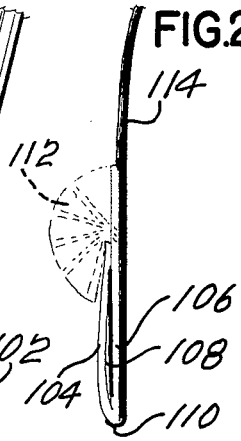
Figure 23:
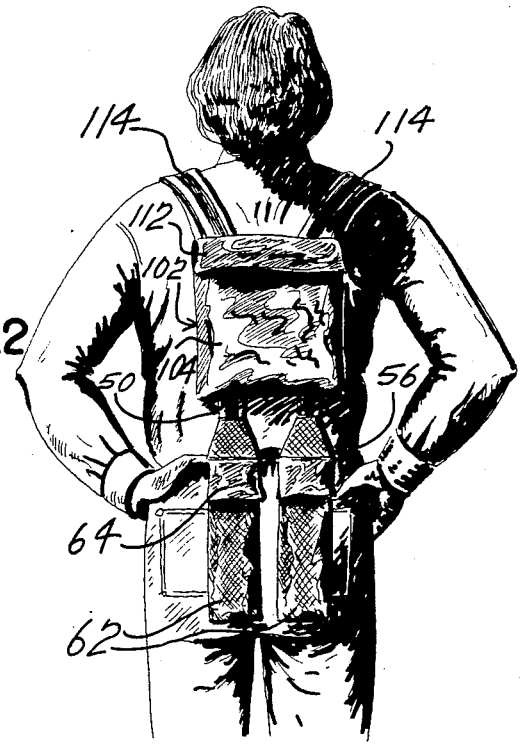
Figure 24:
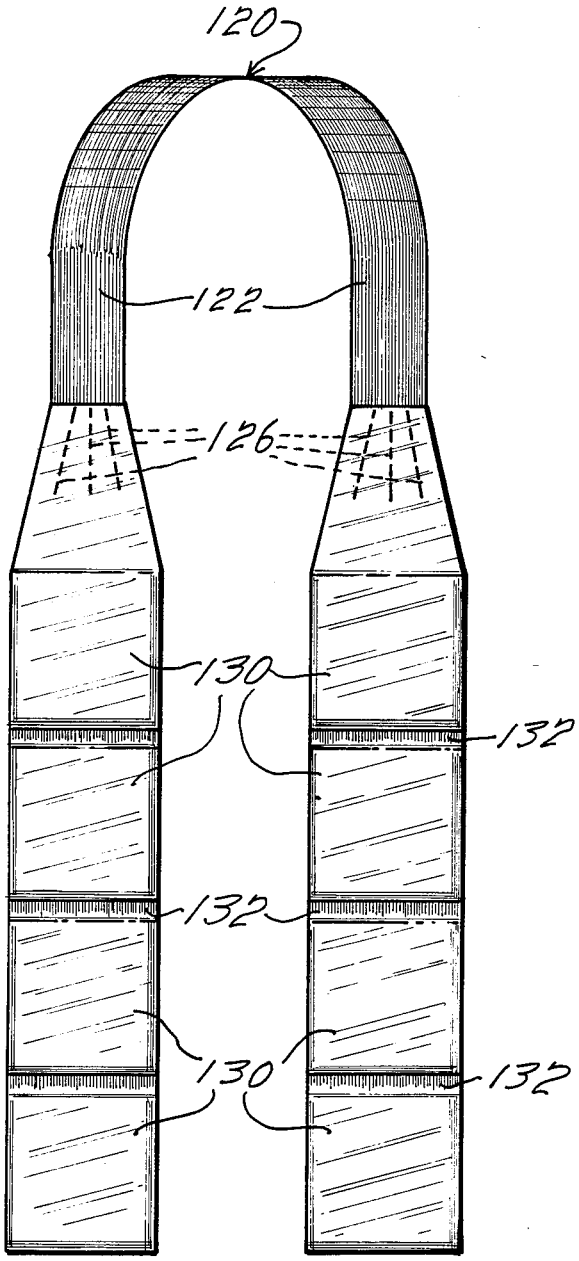
Figure 25:
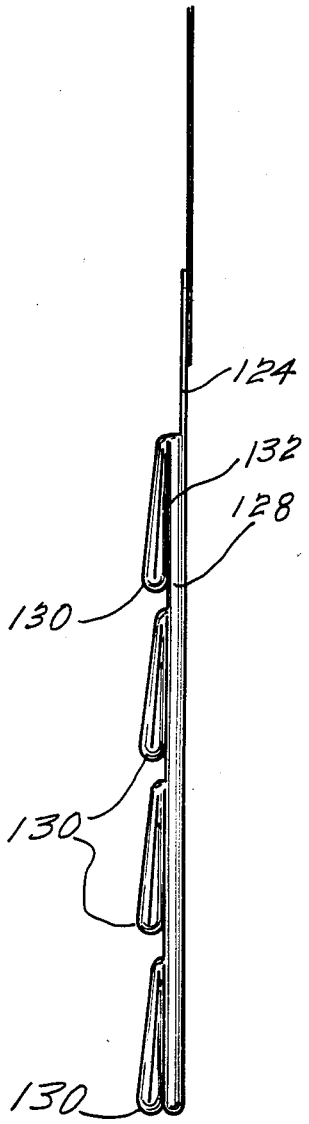
Figure 26:
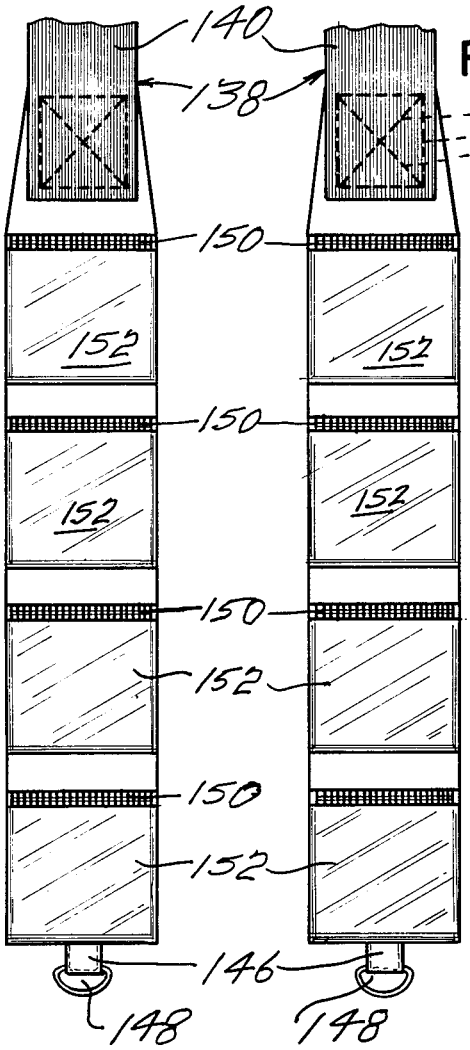
Figure 27:
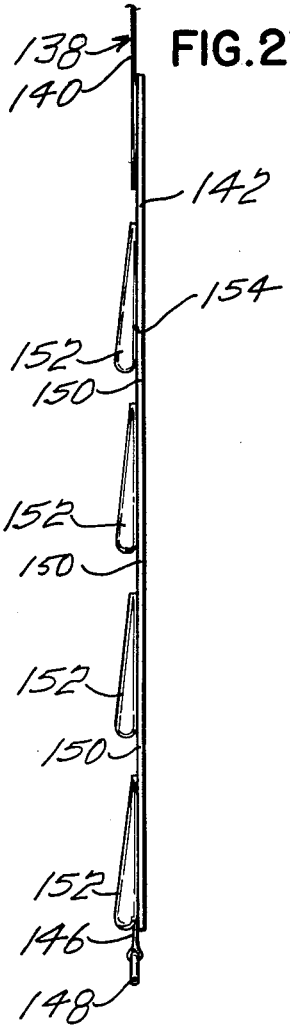
Figure 28:
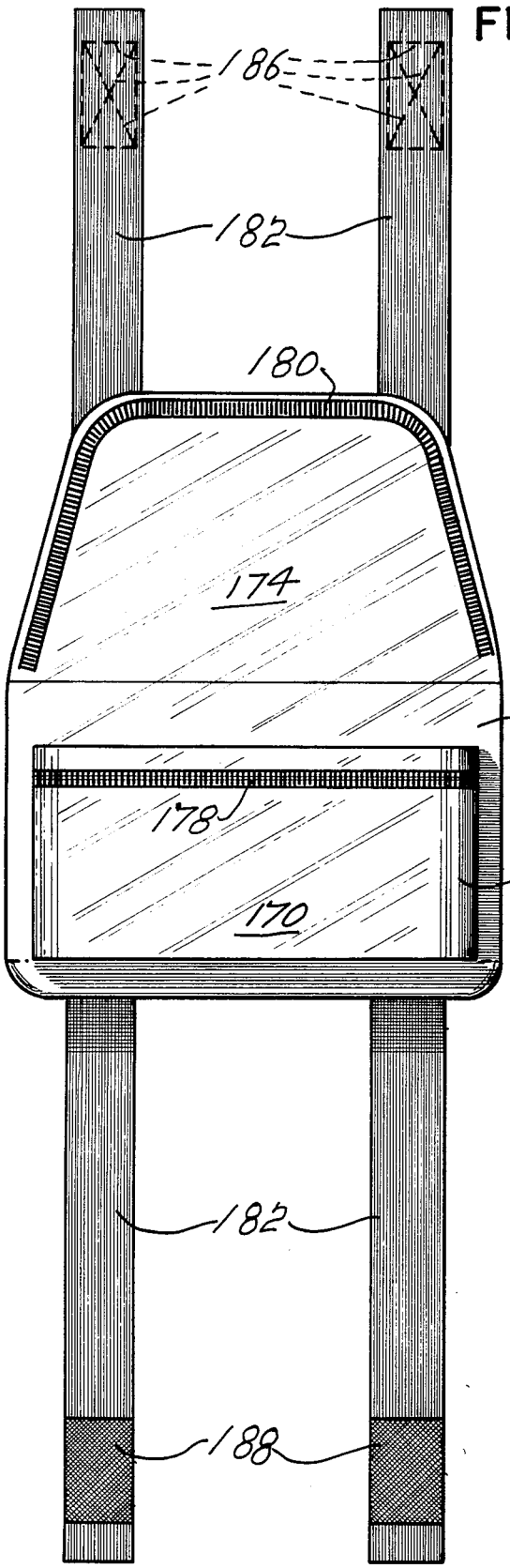
Figure 29:
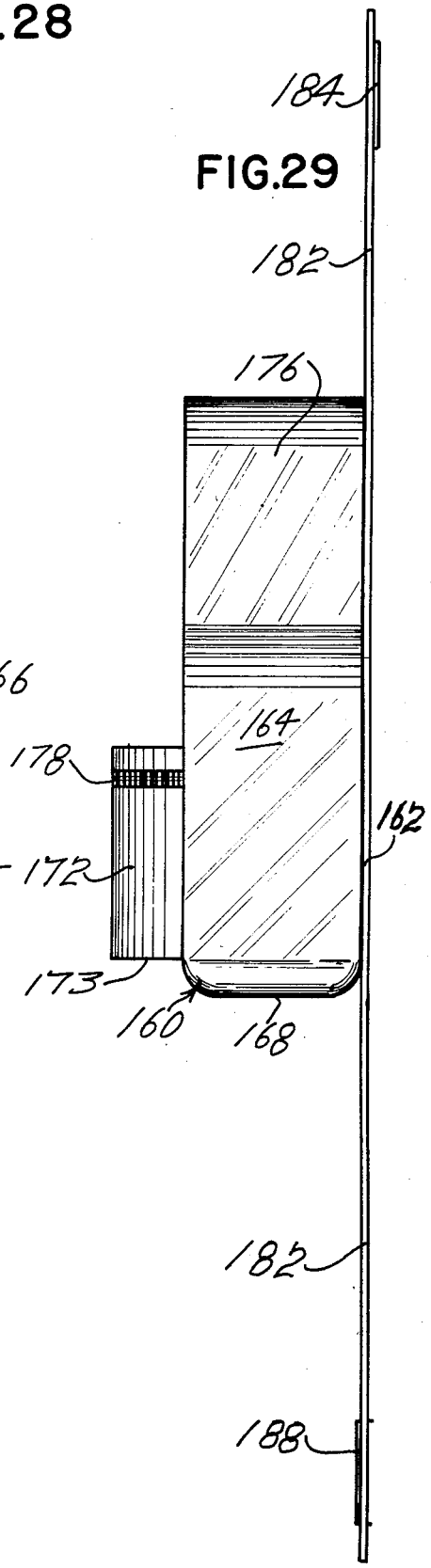
Figure 30:
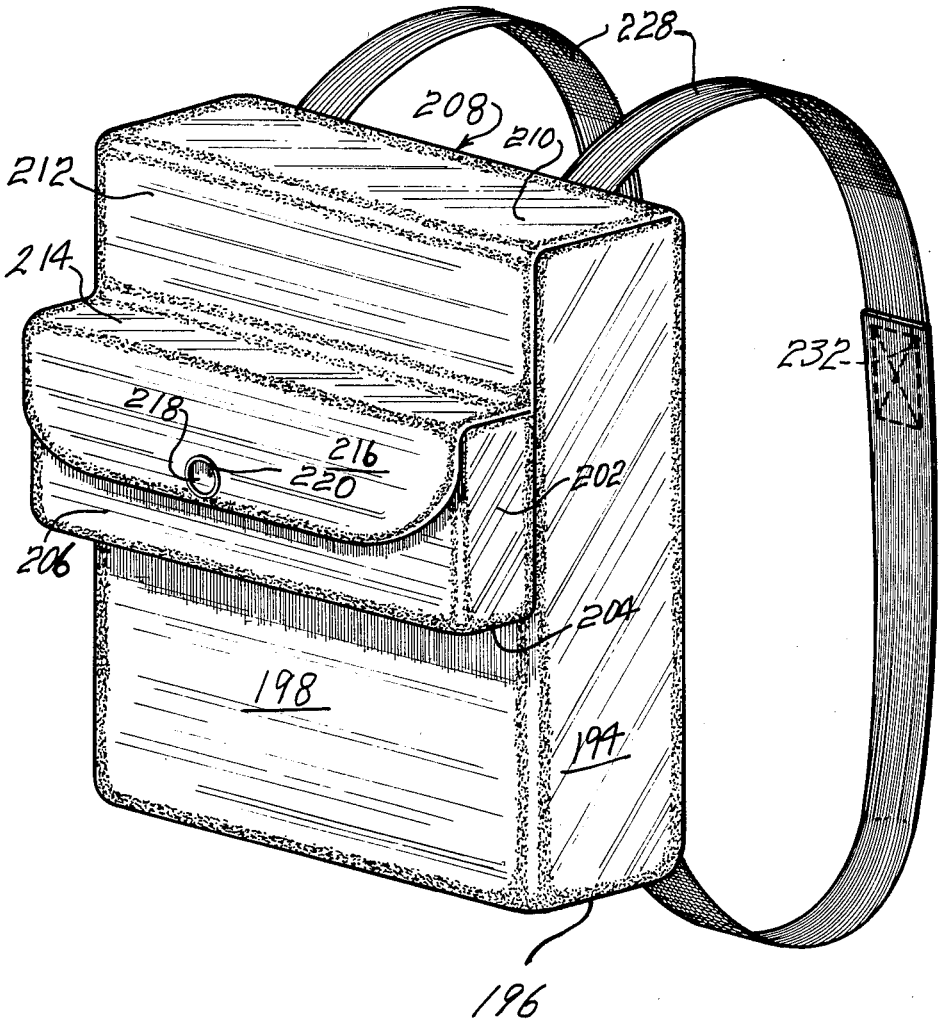
Figure 31:
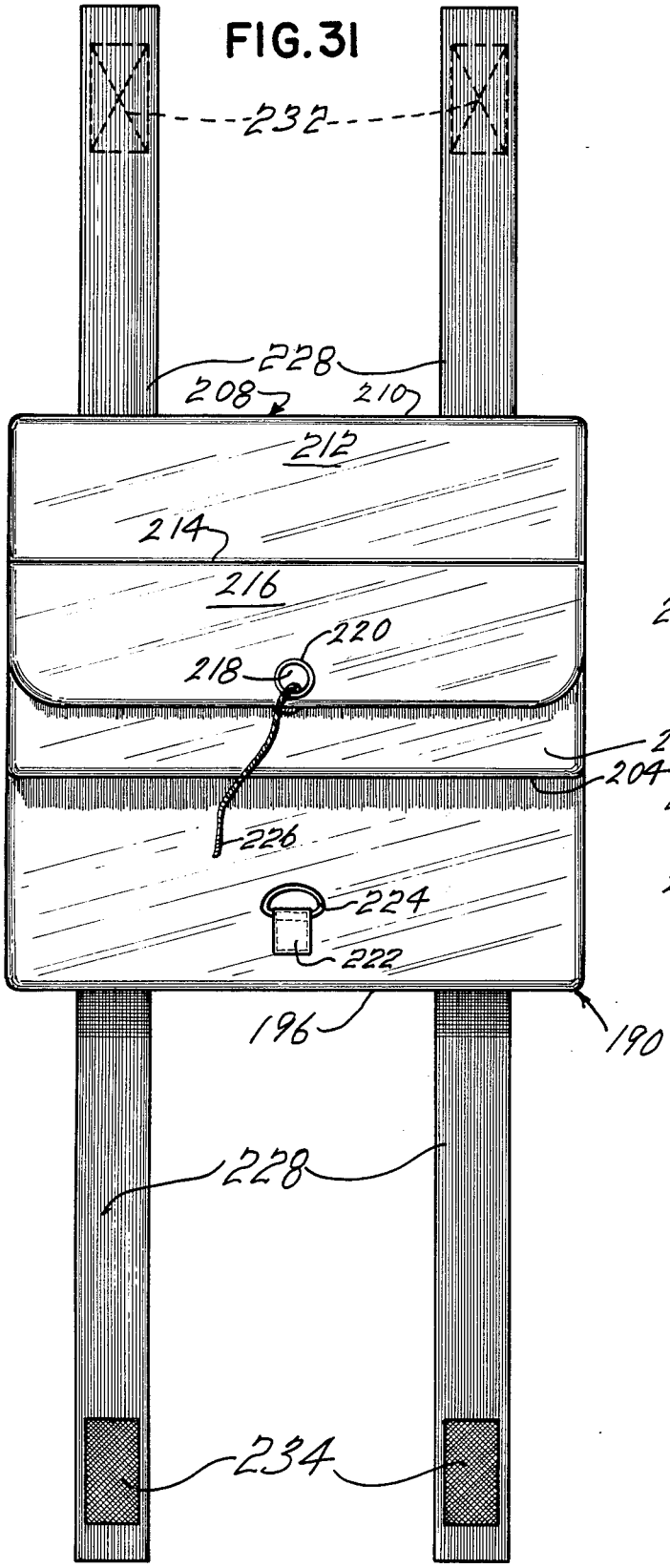
Figure 32:
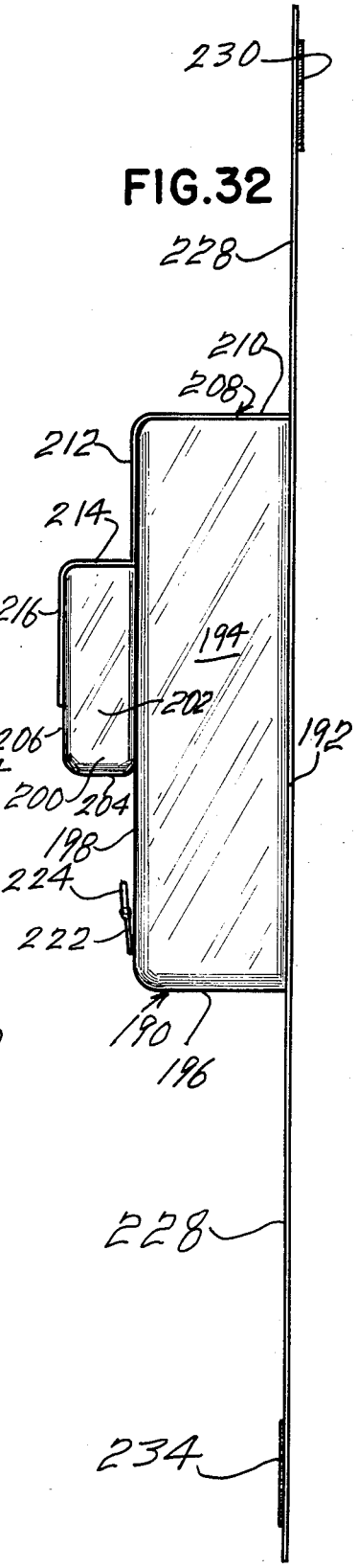
Figure 33:
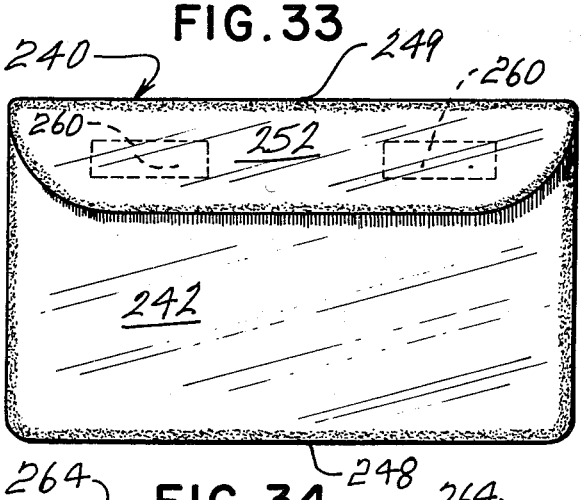
Figure 34:
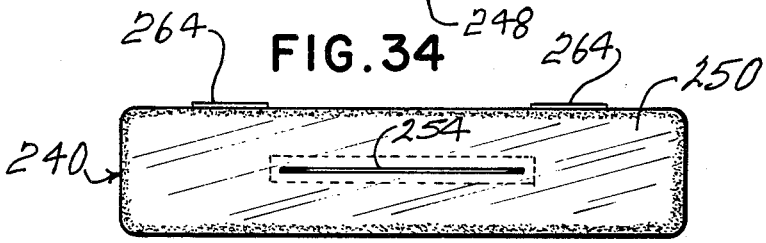
Figure 35:
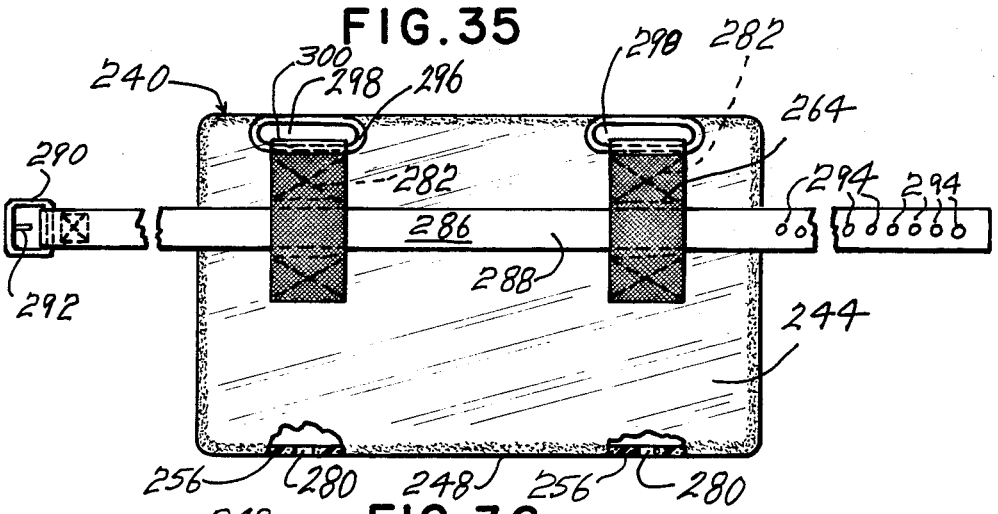
Figure 36:
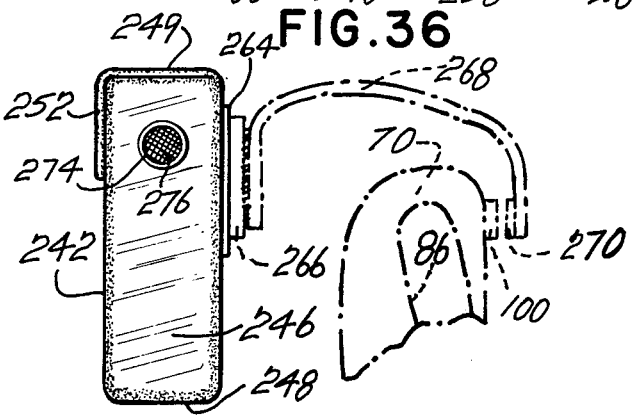
Figure 37:
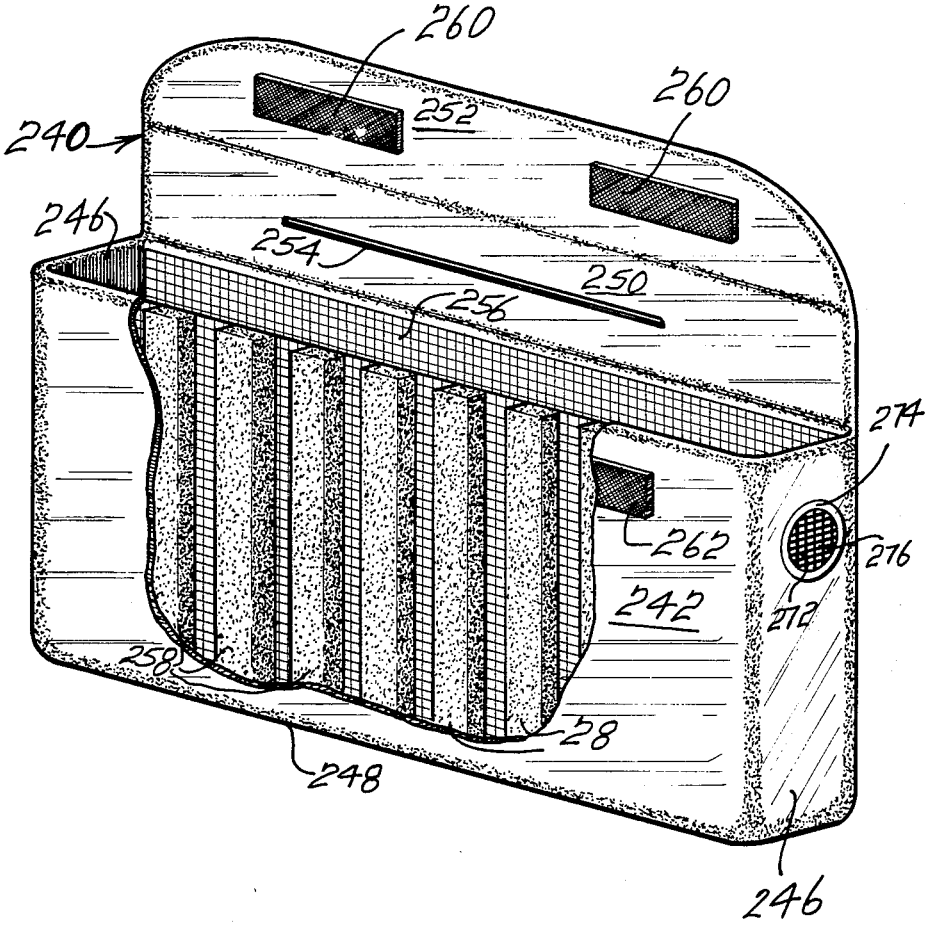
Figure 38:
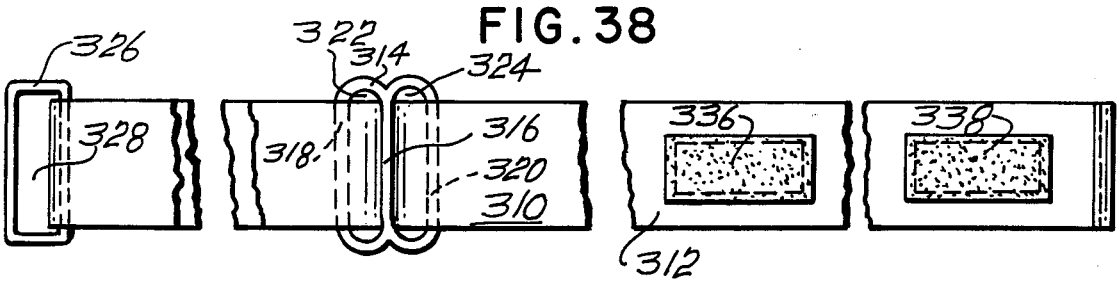
Figure 39:
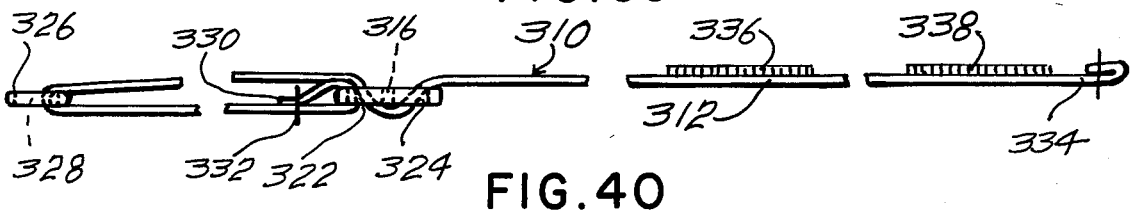
Figure 40:
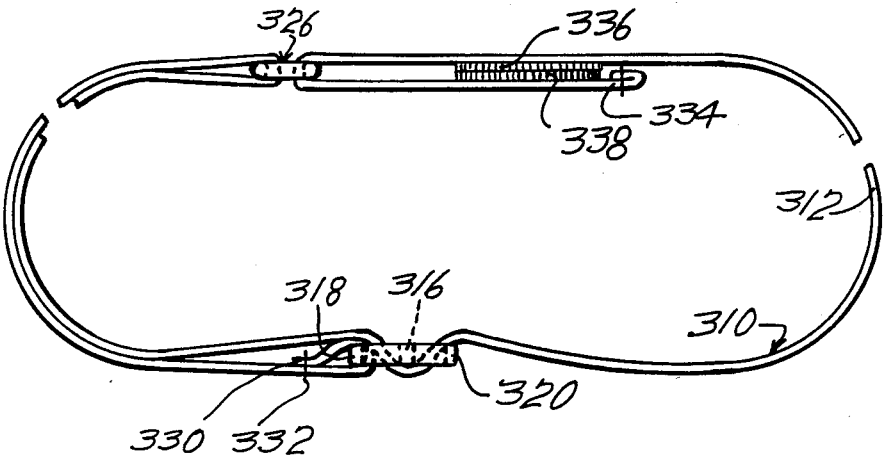
Figure 41:
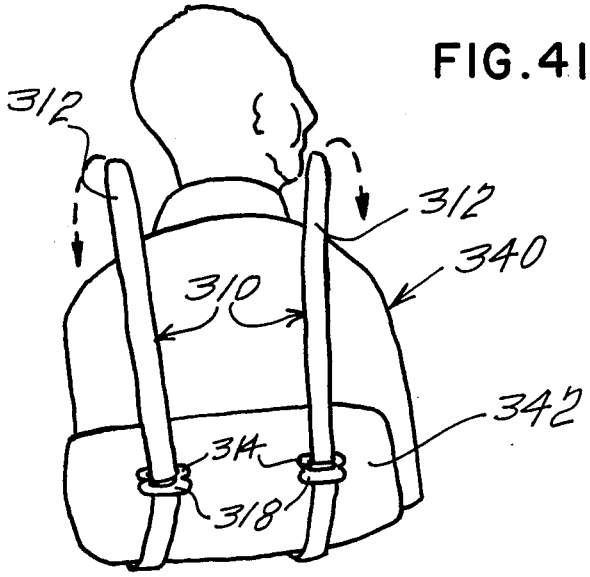
Figure 42:
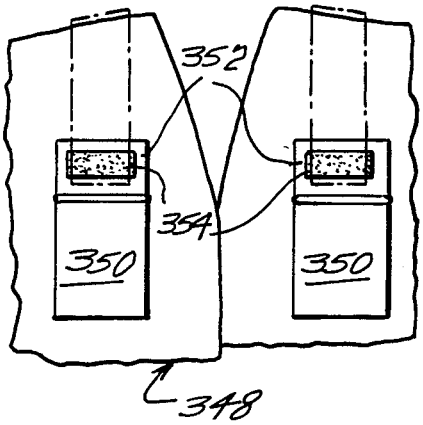
Figure 43:
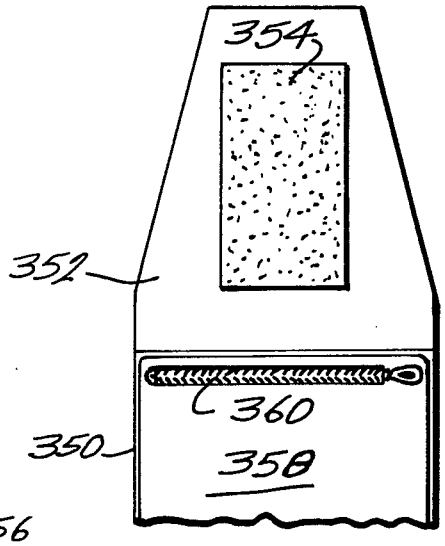
Figure 44:
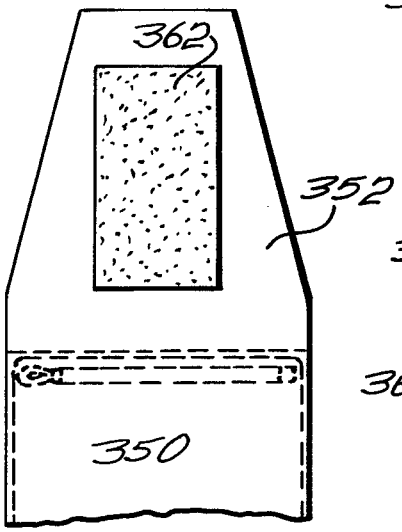
Figure 45:
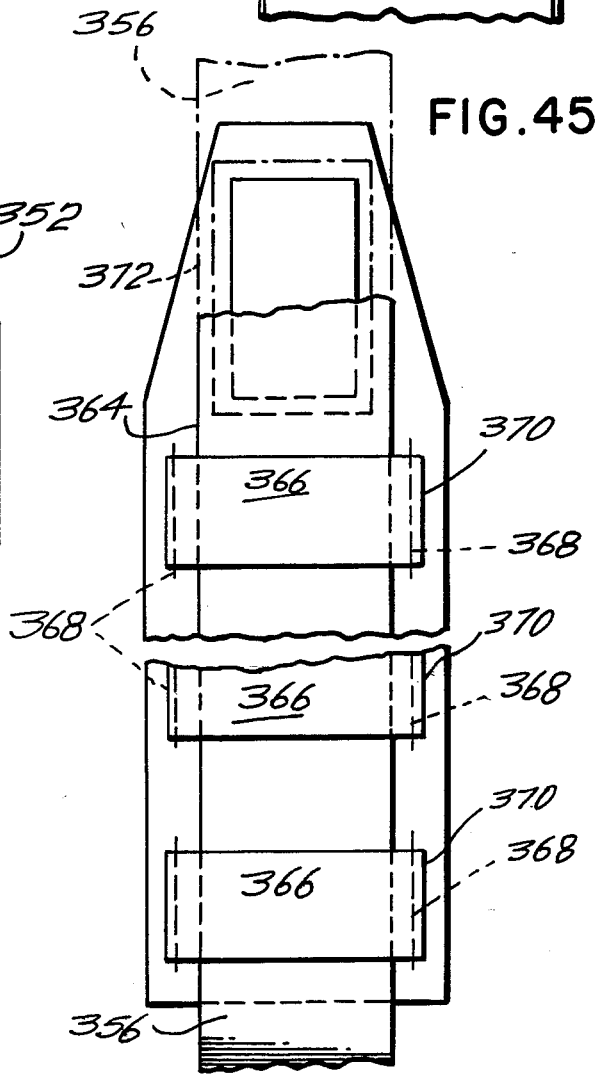
Figure 46:
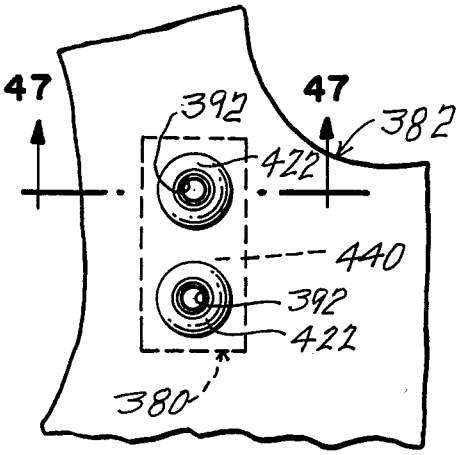
Figure 47:
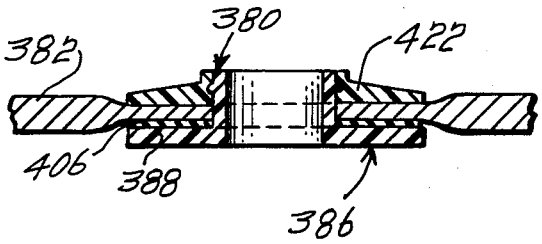
Figure 48:
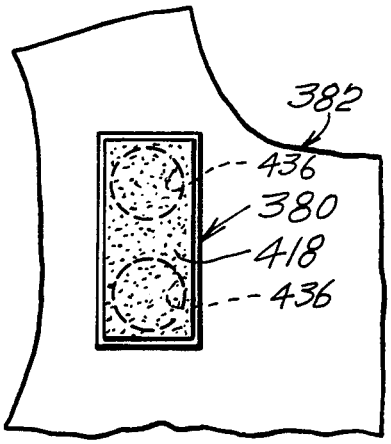
Figure 49:
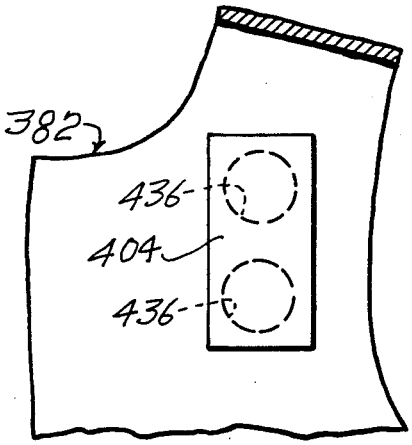
Figure 50:
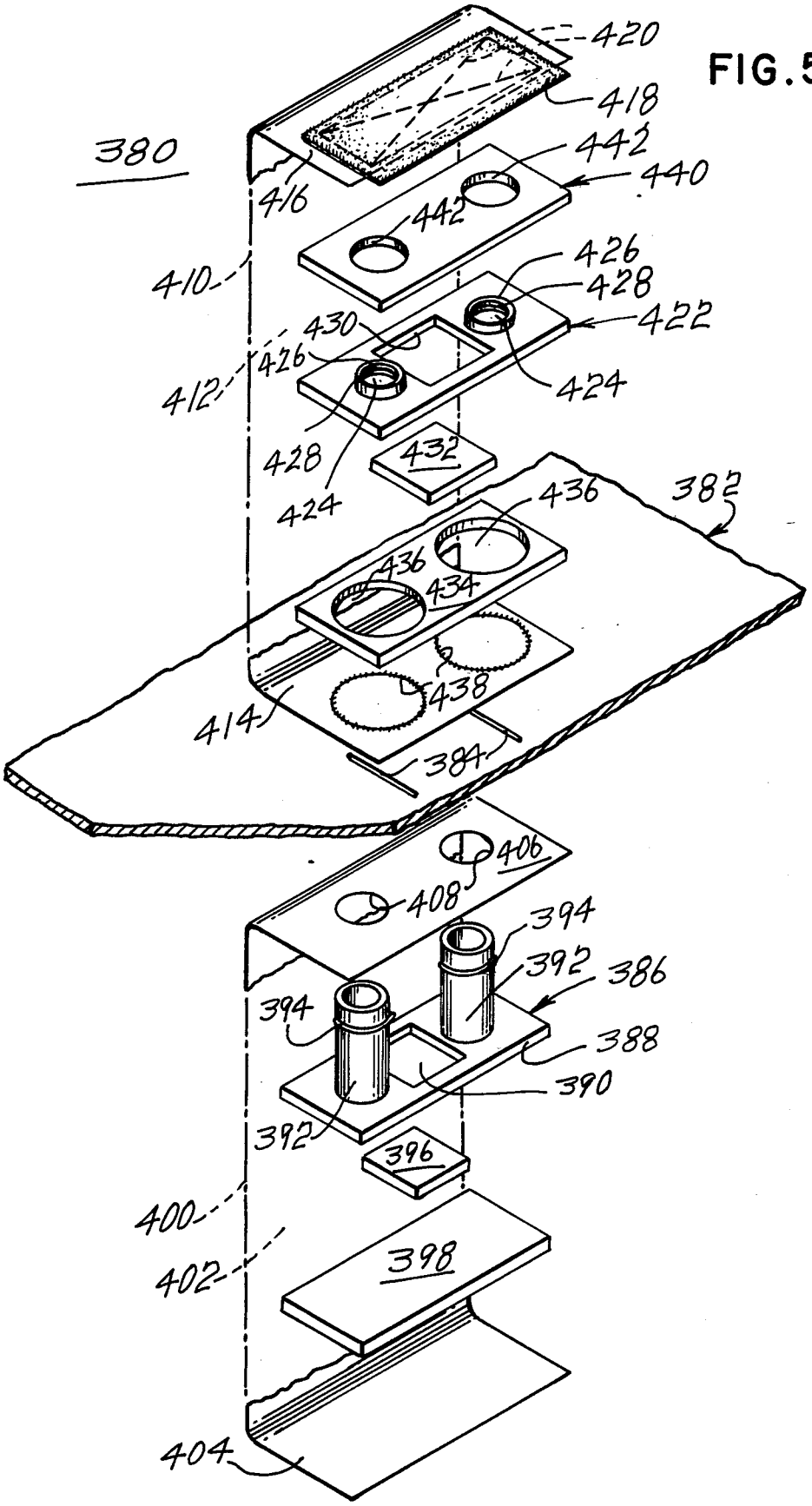
Figure 51:
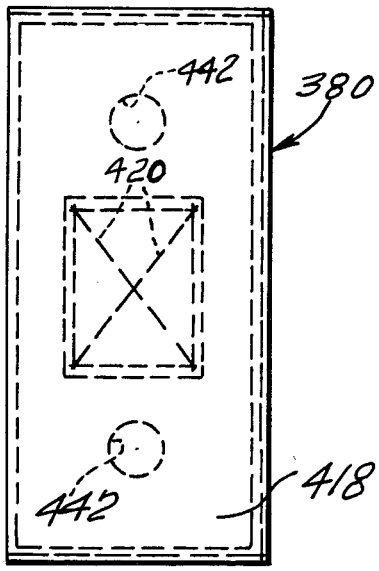
Figure 52:
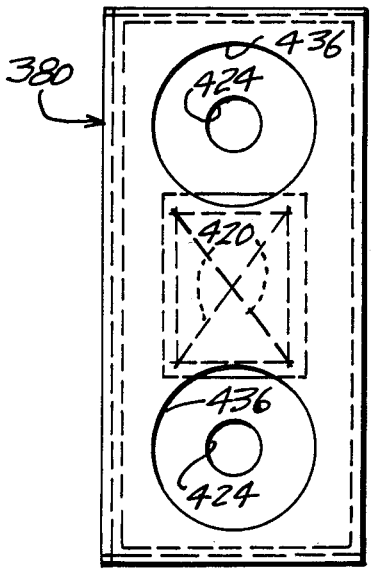
Figure 53:
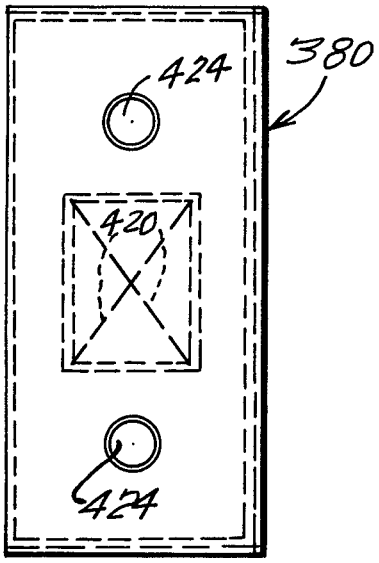
Figure 54:
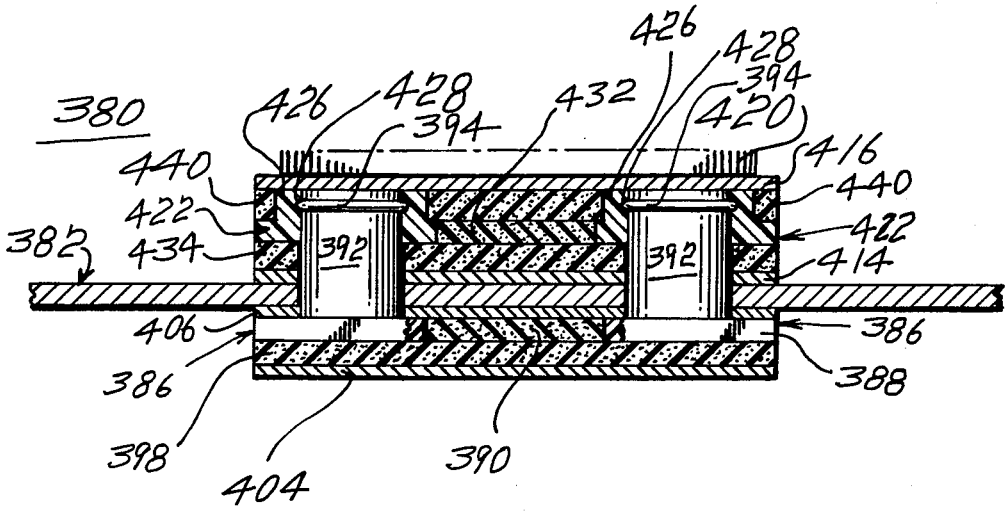

FIG. 11 is a side elevational view illustrating the first attaching means in three positions with the left illustration illustrating the first attaching means on the garments such as a jacket or shirt, the middle illustration illustrating the first attaching means being placed in position on the garment or shirt and the right illustration illustrating the various components of the first attaching means;

FIG. 12 is an elevational view of the back of a person having suspenders and pockets on the suspenders and also illustrates a jacket or a shirt with a bag or pack on the back of the jacket or shirt and supported by the jacket or shirt;

FIG. 13 is a front elevational view of a person wearing a jacket or a shirt and illustrating the first attaching means in the upper part of the front of the jacket or shirt;

FIG. 14 is a rear elevational view of a person wearing a jacket or shirt;

FIG. 15 is a front elevational view of a person wearing a jacket or a shirt and illustrates the strap and the second attaching means on the strap in a fitting relationship with the first means on the jacket or shirt;

FIG. 16 is a rear elevational view of a person wearing a jacket or a shirt and illustrates the straps going over the shoulders and also, the straps connecting with a bag or a pack and which bag or pack is supported by the first attaching means on the jacket or shirt and also, by the second attaching means on the straps;

FIG. 17 is a front outside elevational view illustrating the bag and two straps connecting with the bag;

FIG. 18 is an inside elevational view of the bag and the two straps connecting with the bag and showing the second attaching means on the free ends of the straps;

FIG. 19, on a fragmentary smaller scale, is an elevational view looking at the outside of the bag and showing the strap and with the flap of the bag in a closed position;

FIG. 20 is a side elevational view of the bag of FIG. 19 and illustrates the straps and shows the flap in a closed position;

FIG. 21 is a fragmentary elevational view looking at the outside of the bag and illustrates the straps and shows the flap in an open position;

FIG. 22 is a side elevational view of the bag of FIG. 21 and illustrates the straps and shows the flap in a variety of open positions;

FIG. 23 is an elevational view of the back of a person and illustrates the person wearing suspenders and having pockets attached to the suspenders and also illustrates the person having a pack and straps and the straps going over the shoulders of the person for attaching to the upper front part of the shirt of the person;

FIG. 24 is a front elevational view of a strap and positioned on the strap are a number of pockets or pouches and said strap may be worn over the shoulder of a person or around the neck of a person;

FIG. 25 is a side elevational view of said strap and illustrates the pockets or pouches positioned on the strap;

FIG. 26 is a fragmentary front elevational view of a pair of suspenders and on the suspenders are mounted a plurality of pockets or pouches and at the bottom of the suspenders are tie-down rings for attaching the suspenders to a pair of pants;

FIG. 27 is a side elevational view of said suspenders and illustrates the pouches or pockets mounted on the suspenders and also illustrates the tie-down rings;

FIG. 28 is a front elevational view of the pouch having a cover flap and a means on the pouch and a means on the cover flap for interconnecting the cover flap and the body of the pouch so as to secure the position of the cover flap and also illustrates straps having means which can connect with each other so that a person can wear the straps and pouch over the back with the straps going over the shoulders and under the arms;

FIG. 29 is a side elevational view of said pouch and straps;

FIG. 30 is a perspective view of said pouch, with the cover closed, and with the straps united at their ends to illustrate the manner in which the straps can go over the shoulders of an individual and under the arms of the individual so as to, comfortably, carry the pouch;

FIG. 31 is a front elevational view of another version of the pouch having a cover and a ring in the cover and a tie-down ring on the pouch with a cord which can be used to tie the cover to the main body of the pouch and also illustrates straps attached to the pouch and which straps have on their ends means for uniting together so that the straps can be placed over the shoulders and under the arms of an individual;

FIG. 32 is a side elevational view of said pouch illustrating the cover in a closed position and also illustrating the tie-down ring and the main body of the cover and illustrates the straps attached to the pouch;

FIG. 33 is a front elevational view of a pouch, which can be used as a fishing creel, and illustrates the main body of the pouch and the overlying front flap of the top closure;

FIG. 34 is a top plan view of the pouch and illustrates a slit in the top closure flap or the cover of the pouch;

FIG. 35 is a rear elevational view of the pouch and illustrates attaching means on the back panel of the pouch;

FIG. 36 is a side elevational view of the pouch and illustrates a screen over an opening in the pouch and also, schematically, illustrates straps connecting with the attaching means on the back panel of the pouch and also with a garment worn by an individual;

FIG. 37 is a fragmentary perspective view of the pouch and illustrates, with the front panel partially broken away, the inner construction of the pouch and illustrates separation strips and a screen inside of the pouch so as to space an object such as a fish, away from the walls of the pouch, and to allow the water in the pouch to evaporate and keep the contents of the pouch in a cool state;

FIG. 38 is a front elevational view of an adjustable carrying strap in an out-stretched state;

FIG. 39 is a side elevational view of the adjustable carrying strap in an out-stretched state;

FIG. 40 is a side elevational view of the adjustable carrying strap, formed into the configuration of a loop, with no free ends;

FIG. 41 is a rear elevational view of an individual with a back pack and illustrates two of said adjustable carrying straps for going over the shoulders and underneath the armpits of the individual;

FIG. 42 is a front elevational view of a jacket or a shirt, having first attaching means on the inside of a flap for a pocket and also a strap, having second attaching means, connecting with the first attaching means on the flap for the pocket;

FIG. 43, on an enlarged scale, is a front elevational view of a pocket having a flap in a raised position with a first attaching means on the inside of the flap;

FIG. 44 is a rear elevational view of the pocket having the flap in a raised position, with a second attaching means on the outside of the flap;

FIG. 45 is a rear elevational view of a pocket with loops on the back of the pocket, and suspenders in the loops and with suspenders connecting with attaching means on the flap;

FIG. 46 is a fragmentary front elevational view of a garment, showing two grommets for connecting with an attaching means;

FIG. 47, on an enlarged scale, is a fragmentary side elevational view showing the cloth of the garment and the construction of a grommet positioned in and by said cloth;

FIG. 48, on a reduced scale, is a fragmentary front elevational view of the exposed surface of a first attaching means positioned on the two grommets of FIG. 46, and which exposed surface of the first attaching means is on the outside of the garment;

FIG. 49 is a fragmentary front elevational view of the exposed surface of the mounting means for the two grommets of FIG. 46, and which exposed surface is on the inside of the garment;

FIG. 50 is an exploded perspective view of the components used for placing an attaching means onto a garment;

FIG. 51 is a view of the exposed surface of the attaching means of FIG. 50;

FIG. 52 is a rear view of the attaching means of FIG. 50 and illustrates the inner surface of the grommets, as seen from the surface of the cloth of the garment;

FIG. 53 is a view illustrating the attaching means and the studs used in conjunction with the grommets for attaching to the cloth of a garment; and FIG. 54 is a cross-sectional view, in the assembled state, showing the use of the grommets and the attaching means for connecting with the cloth of a garment.

THE DETAILED DESCRIPTION OF THE INVENTION

This invention is directed to a support for supporting a pouch or a pocket for carrying items. The support can be an article of clothing, such as a body garment. For lightweight and small articles it is not necessary to have a back pack or a packboard when hiking or fishing. A person may wish to go for a short hike or may wish to go fishing. Many times this person will carry a back pack or a packboard. The back pack or the packboard is extra weight and, may have more capacity than is required for the short hike or for fishing. This invention is directed to using an article of clothing as a support for a pouch or pocket to carry items. There is no need to have a back pack or a packboard when using this invention. The articles of clothing can be, readily, adapted as a support for supporting a pouch or a pocket for carrying small items.

In FIGS. 1–7 there is illustrated a pair of suspenders 50, which have been modified to support or carry a pouch or pocket 62.

It is seen that the suspenders 50 comprise a strap 52, and a cross member 54.

There is attached to the strap 52 a cloth member 56. The cloth member 56 may be attached to each end of each strap 52. The strap 52 connects with a buckle 58 and is folded back on itself through the buckle 58. By means of the buckle 58 the length of the strap 52 can be varied so that the suspenders can be adapted to fit people of different builds and different heights. The strap 52 in folding back on itself forms a loop at its outer end and positioned in this loop is a snap 60 as as to attach the end of the suspenders or the end of the strap to a pair of pants.

There can be attached to the cloth 56, a series of pockets 62. The pockets 62 or pouches 62 may be unitary and have a front panel and a back panel and side panels and also a bottom. The pouch 62 can have an open top. There can be attached to the cloth 56 a covered flap 64, for the open top of the pocket 62. It is conceivable that the cover flap 64 can also be part of the back panel of the pocket 62.

Figure 1:
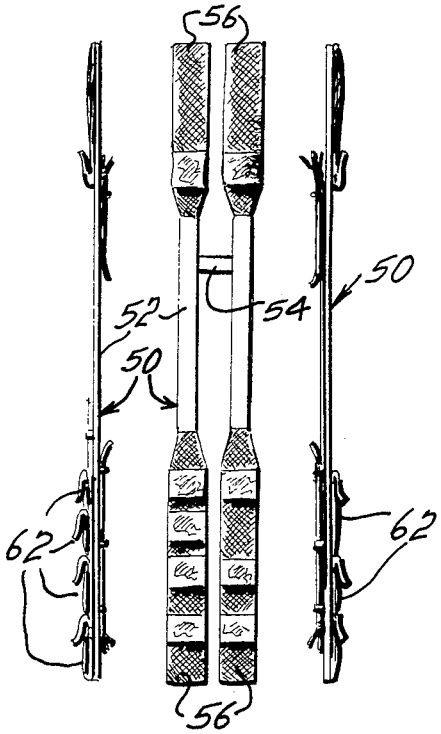
FIG. 1 is a combination of an elevational view of the front of suspenders and side elevation view of the suspenders wherein the suspenders have been modified to act as a base or a basic support for a plurality of small pockets which are, removably, attached to the suspenders.
Figure 2:
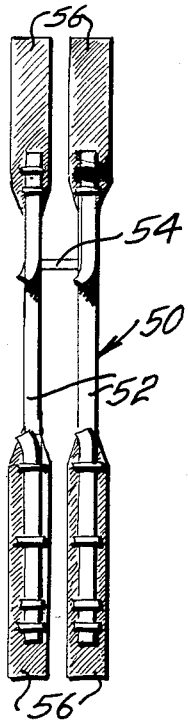
FIG. 2 is a rear elevational view of the back of the suspenders which have been modified to function as a base or a basic support for a plurality of pockets.
Figure 3:
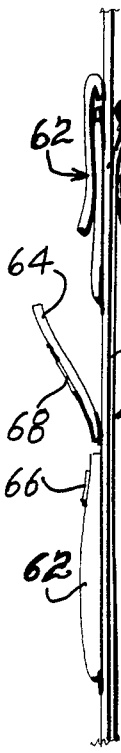
FIG. 3 is a side elevational fragmentary view illustrating part of the suspender and the pockets attached to the suspender.
Figure 4:
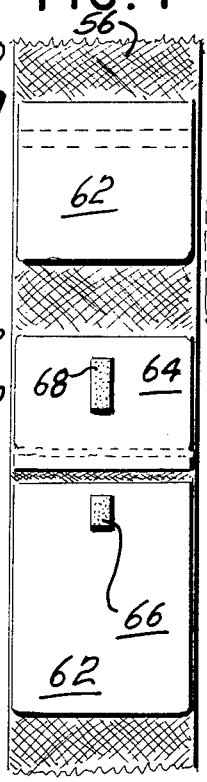
FIG. 4 is a front elevational fragmentary view of the suspender and illustrates the pockets mounted on the suspender.
Figure 5:
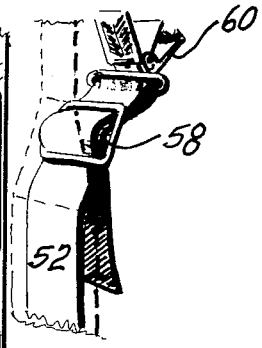
FIG. 5 is a fragmentary view illustrating the buckle so that the suspender can be adjusted to various lengths.
Figure 6:
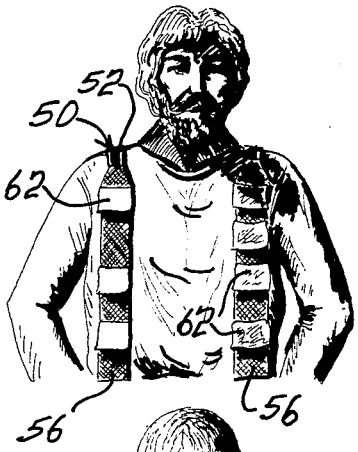
FIG. 6 is a fragmentary front elevational view illustrating the suspenders on an individual and the pockets mounted on the suspenders.
Figure 7:
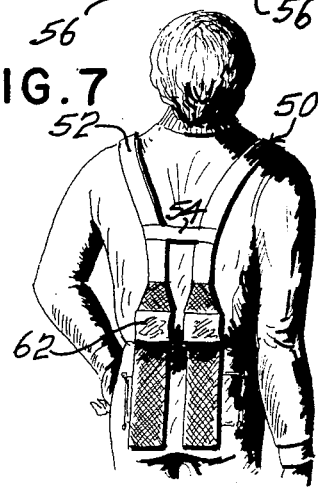
FIG. 7 is a rear elevational view of an individual wearing the suspenders and with the pockets mounted on the suspenders.

In FIG. 4, it is seen that there is a first attaching means 66 on the upper part of the front panel of the pouch 62 and that on the inside of the cover flap 64 there is a second attaching means 68. The first attaching means 66 and the second attaching means 68 are so positioned that when the cover flap is lowered over the opening of the pouch the attaching means contact each other so as to definitely position the cover with respect to the pocket or pouch 62.

The pocket 62, because it is positioned on the suspender, is relatively small. This pocket can be used for carrying small items such as matches, fish hooks, leader, sinkers, spinners, flies, fishlines, weights and a compass to name a few of the items. The pocket or pockets are convenient for the person to reach and to pull out an item such as a fish hook or a leader or a sinker. Also, since the support for the pouch 62 is part of an article of clothing the weight added by the pockets is a small weight as contrasted to the weight added by a back pack or a packboard.

In FIGS. 8–23 there is illustrated another species of the invention. In this species an attaching means can be attached to an article of clothing. Then, a pouch or a bag, can be, releasably, attached to the attaching means on the article of clothing. The article of clothing becomes the support for the attaching means which in turn assists in connecting the pouch or bag to the article of clothing. The article of clothing supports the pouch or bag and eliminates the necessity of having a body pack or a packboard separate from the article of clothing. As a result there is an elimination of excess weight in the packboard or the body pack.

In the figures it is seen that there is an article of clothing 70, which can be an upper body garment such as a shirt, jacket or vest. The article of clothing 70 comprises a body portion 80 and a first arm portion 82 and a second arm portion 84. There are armholes 86. The wearer can put his arms through the armholes 86, so that the body portion 80 covers his back and the arm portions 82 and 84 cover his sides and front.

Figure 10:
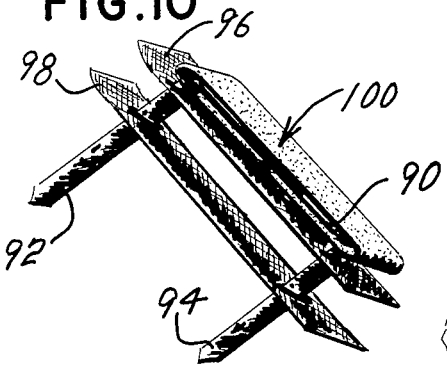
FIG. 10 is a semi-exploded view illustrating the components of a first attaching means for attaching to a jacket.

There is a means 88 for attaching to the support such as the article of clothing 70. The means 88 comprises a base member 90, a first arm 92 and a second arm 94. There is positioned on the outside of the article of clothing 70 a first reinforcing plate 96 or an outside reinforcing plate 96 and on the inside of the article of clothing 70 there is a second reinforcing plate 98 or an inside reinforcing plate 98. In FIG. 10 there is illustrated the means 88. In FIG. 11 there is illustrated the means 88 as attached to the article of clothing 70 and there is illustrated the outside reinforcing plate 96 and the inside reinforcing plate 98 and there is also illustrated the base member 90 with the first arm 92 and the second arm 94 folded over the member 90.

Figure 8:
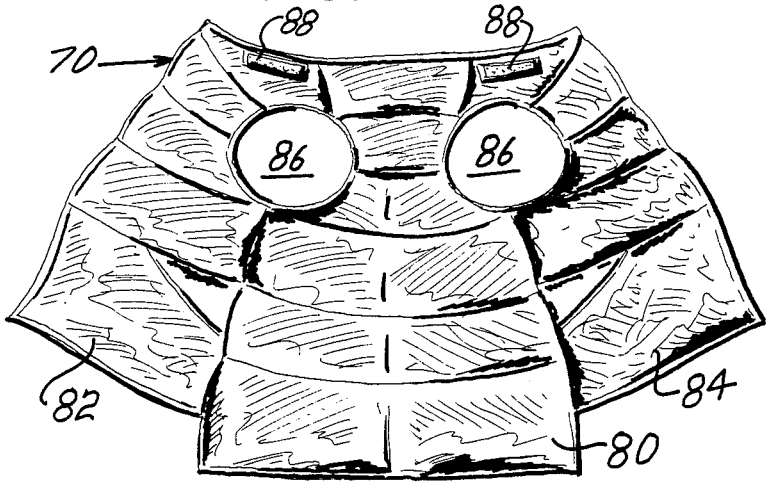
FIG. 8 is a front elevational view of a jacket or a shirt opened and illustrating a first attaching means mounted on the jacket or shirt.

On the outside of the base member 90 there is a first attaching means 100. In FIG. 8 there is illustrated the outside of the article of clothing 70 and there is also illustrated the means 88 and the first attaching means 100.

Figure 9:
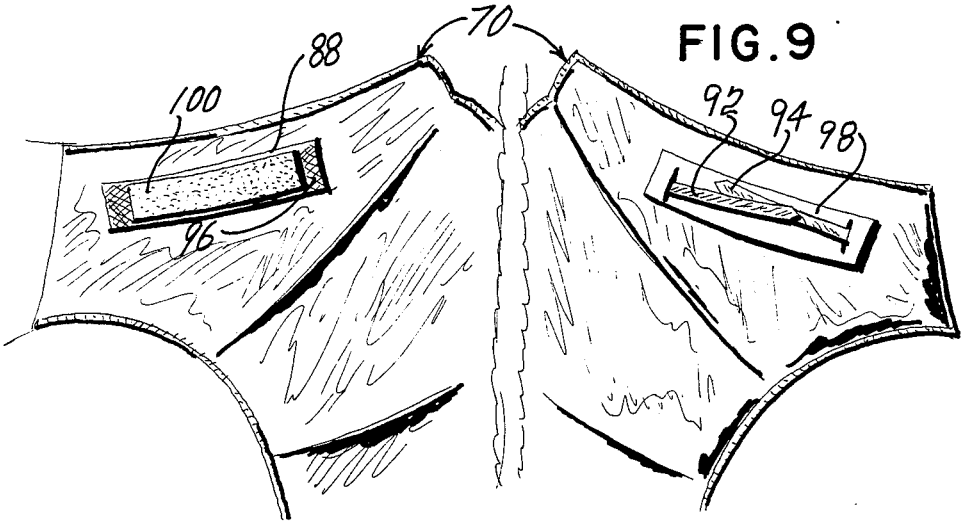
FIG. 9 is a combination view illustrating both sides of a jacket or a shirt and illustrates, on the left, the outer part of the jacket and the outer part of the first attaching means and illustrates on the right, the inner part of the jacket and the inner part of the first attaching means.

In FIG. 9, on an expanded scale, there is illustrated on the left part the means 88 on the outside of the garment and on the right part there is illustrated the inside of the garment and the inside reinforcing plate 98 and the arm 92 and the arm 94.

In FIG. 13 there is illustrated the front of the article of clothing 70 on an individual and also the means 88. In FIG. 14 there is illustrated the article of clothing 70 on the individual and the illustration is of the back part of the article of clothing.

In FIGS. 13 and 14 there is no pouch or bag attached to the means 88.

In FIGS. 17–21 there is illustrated a pouch or bag 102 having a front panel 104 and a back panel 106. Also, the pouch or bag 102 has side panel 108 and a bottom 110. There is a cover flap 112 for the opening at the top of the pouch or bag.

There is attached to the pouch or bag 102 two straps 114. These straps may be sewn with the pouch or bag or attached by a suitable adhesive.

In FIG. 18 it is seen that on the outer and upper inside surface of the straps 114 there is a second attaching means 116.

In FIGS. 12, 15, 16 and 23 there is illustrated the second attaching means 116 attached to the first attaching means 100, on the means 88, so that the straps go over the shoulder of the wearer of the article of clothing 70 and the pouch or bag is carried on the back of the wearer of the article of clothing.

It is seen that the article of clothing 70 acts as a support for the pouch or bag 102. In this manner the pouch or bag can be carried by the individual for carrying articles such as food, socks, or a shirt, fishing equipment, a knife or other items a person may use when going for a hike or going fishing.

The first attaching means 100 and the second attaching means 116 are, releasably, attachable with respect to each other. These attaching means can be engaged so that the straps are, definitely, positioned with respect to the wearer and on the article of clothing 70. Then, after the pouch or bag 102 has served its purpose the two straps may be removed from the means 88 on the article of clothing 70 and the article of clothing used primarily for warmth and comfort and not as a support for the pouch or bag 102.

The means 88 can be inserted through the fabric of the article of clothing 70 and attached to the article of clothing. The means 88 can be low cost and light in weight and serve as a suitable attaching means to the article of clothing 70. After the pouch or bag 102 has been removed it is possible also to remove the means 88 from the article of clothing so as not to show on the clothing 70. The means 88 can be placed in the pouch or bag 102, when not in use.

In FIGS. 24 and 25 there is illustrated a carrying strap 120. This carrying strap 120 comprises a strap 122 and a base 124. As a strap 122 has two ends there is a base 124 attached to each end by stitching 126.

On the base 124 there is a first attaching means 128. There is a pocket or pouch 130 having on its back panel a second attaching means 132. The pocket or pouch 130 can be pressed against the base 124 so that the second attaching means 132 connects with and attaches to the first attaching means 128 to definitely position the pockets or pouch 130 on the base 124 and on the strap 120.

The pockets or pouches 130 can be used for carrying small items such as fish hooks, matches, flies, leader, fish line and the like.

The carrying strap 120 can be placed around the neck of the individual so that the pockets are on the chest on the individual or on the back of the individual. Also, the carrying strap 120 can be placed over the shoulder of an individual or carried on the arm of an individual.

To repeat, the pockets 130 can be detachably positioned or releasably positioned on the base 124 by the second attaching means 132 engaging with the first attaching means 128.

In FIGS. 26 and 27 there is illustrated another species of the invention comprising a pair of suspenders 138. The suspenders 138 comprise two elastic straps 140 and a base 142. The straps 140 and the base 142 are connected by stitching 144.

There is attached to each end of the base 142 a loop 146. A tie-down ring 148 is positioned in the loop 146.

On the base 142 there is a first attaching means 150.

A pocket or pouch 152 has a second attaching means 154 on its back panel. The pocket or pouch can be attached to the base 142 by pressing the second attaching means 154 against the first attaching means 150.

The pouch or pocket 152 can be releasably attached to the base in that manner and can be positioned on the base in that manner.

The pocket or pouch 152 can be used for carrying items such as matches, flies, fish hooks, leader, shoe strings and the like.

The tie-down ring 148 can be used for connecting the suspenders to the pants of an individual or for tying down the suspenders 138 so they are definitely positioned on the individual.

In FIGS. 28 and 29 there is illustrated a bag 160 having a back panel 162, side panels 164, a front panel 166 and a bottom 168. On the bag 160 there is a front pouch 170 having a wrap around front panel 172 and a bottom panel 173.

There is a cover flap 174 having a stiff circumscribing side 176.

On the front pouch 170, near the top, there is a first attaching means 178. On the cover flap 174 there is a second attaching means 180. The cover flap 174 can be securely positioned over the bag 160 and the front pouch 170 by pressing the second attaching means 180 onto the first attaching means 178.

There are two spaced-apart straps 182. The bag 160, by means of the back panel 162, is attached to the two spaced-apart straps 182. The bag 160 may be attached to the straps by means of a suitable adhesive or by means of stitching.

There is attached at the upper ends of the straps 182 a first attaching means 184. The attaching means may be attached to the straps by means of stitching 186.

At the lower ends of the straps 182 there is attached a second attaching means 188. Each of the straps may be formed onto a loop with itself by pressing the attaching means 184 and the attaching means 188 against each other. The pouch, by means of the straps and the attaching means, may be worn over the shoulders of an individual.

The bag and the pouch may be used for storing items such as fishing supplies, a flashlight, knife, food, an extra pair of socks and the like.

In FIG. 30 there is illustrated one manner of each of the straps being connected to itself by means of the attaching means so as to form loops for ease of carrying a bag.

In FIGS. 30, 31 and 32 there is illustrated another illustration of a bag 190. This bag 190 has a back panel 192, side panels 194, a bottom 196 and a front panel 198. On the front panel 198 there is a small pouch 200.

The small pouch 200 has side panels 202, a bottom 204 and a front panel 206.

For the bag 196 and the small pouch 200 there is a stiff cover 208 having an upper top panel 210, an upper front panel 212, a lower top panel 214 and a lower front panel 216.

In the lower part of the lower front panel 216 there is a hole 218. There is a ring 220 in the hole 218.

On the front panel 198 of the bag 190 there is a loop 222. A tie-down ring 224 is positioned in the loop 222. A cord or rope 226 passes through the ring 220 and through the tie-down ring 224 so as to tie-down the stiff cover 208 over the bag 196 and over the small pouch 200.

There are two spaced-apart straps 228. The bag 196 can be attached to these two straps 228 by means of the back panel 192. The back panel 192 may be connected with the straps by an adhesive or the back panel may be stitched to the straps 228. On the upper end of each strap 228 there is a first attaching means 230. The first attaching means 230 may be attached to the strap by stitching 232.

On the lower end of each strap 228 there is a second attaching means 234.

In FIG. 30 there is illustrated the straps in the configuration of a loop whereby the first attaching means and the second attaching means in the same strap are pressed together so as to releasably position the ends of the straps.

In FIG. 30 it is seen that a person may put arms through the loops formed by the straps and carry the bag 190 on the person's back.

The bag 190 and the small pouch 200 may be used for carrying various items such as fishing gear, food, an extra pair of socks, matches and the like.

In FIGS. 33–37 there is illustrated a fishing creel 240.

This fishing creel has a front panel 242, a back panel 244, side panels 246 and a bottom 248.

There is a top closure flap 249. This top closure flap 249 may be stiff and comprises a top flap 250 and an overlying front flap 252.

In the top flap 250 there is a slit 254.

In FIG. 37 it is seen that on the inside of the fishing creel 240 there is a screen 256. On the inside of the screen 256 there are flexible ribs 258.

The screen 256 may be a plastic such as a nylon or orlon or other suitable plastic. The screen increases the surface area to facilitate evaporation of moisture to increase the cooling of the inside of the creel so as to have a lower temperature inside the creel.

The flexible spacing ribs may be of plastic such as polyurethane foam. The ribs space the contents of the fishing creel, viz., from the sides so as to allow air to circulate and to allow the water to drop from the fish for cooling purposes. The ribs also allow the water to evaporate from the skin of the fish for cooling purposes. This makes it possible for the temperature inside of the fishing creel to be a lower temperature than outside the fishing creel and thereby assists in preserving the fish.

On the inside of the overlying front flap 252 are first attaching means 260. On the upper part of the front panel 242 are second attaching means 262. The top closure flap may be secured, releasably, to the front panel 252 by pressing the first attaching means 260 onto the second attaching means 262.

On the upper part of the back panel 244 are two spaced-apart attaching means 264.

There may be two spaced-apart straps 268 having second attaching means on one end. On the other end there may be first attaching means 270. As is recalled there is a jacket or an outer garment 70 having armholes 86. On the upper part of the jacket 70 are two spaced-apart attaching means 100. The attaching means 270 may be pressed against attaching means 100 so as to firmly position the straps on to the attaching means 100 and to position the straps with respect to the garment 70 and the person wearing the garment. The straps may go over the shoulder of the person wearing the garment so that the fishing creel can be carried on the back of the person. Or, it is conceivable that the fishing creel can be carried on the front of the person by attaching the attaching means 270 to the attaching means 100.

In the upper part of the side panels 246 are two holes 272. There is a ring 274 around the periphery of the holes. There is a screen 276 which covers the holes 274. The screen allows the circulation of air into and out of the interior of the fishing creel 240.

It is possible for a fisherman, when he catches a fish, to slip the fish through the slit 254 and into the interior of the fishing creel 240. Also, it is possible for a fisherman to hand carry the fishing creel and thereby eliminate the need of straps 268 for attaching to the garment worn by the person.

The flexible spacing ribs 258 are soft and allow the fish to be positioned inside of the fishing creel 240 and allow the person to walk and agitate the fish inside of the fishing creel without harm or damage to the fish. Also, the flexible spacing ribs do allow the fish to be positioned away from the sides and panels of the fishing creel so as to increase air circulation and to decrease the possibility of spoilage of the fish. The screen 256 assists in dispersing the moisture in the fishing creel so as to allow the moisture to evaporate and thereby lower the temperature inside the fishing creel to assist in preserving the fish until they are transported to a desired location for eating or placing in a refrigerator or a cold temperature.

In the bottom 248 of the fishing creel 240 there are two spaced-apart holes 280 which allow the drainage of liquid. Also, these two holes assist in the circulation of air in the interior of the fishing creel.

The fishing creel may be worn over the shoulder, see FIG. 36. There are two straps attached to the fishing creel and these two straps go over the shoulders of the person carrying the creel.

Then, see FIG. 41, there may be one strap, having an attaching means near each end, and the attaching means on the strap can be attached to the attaching means on the fishing creel. The one strap can be worn over the shoulder so as to carry the fishing creel.

Then, the fishing creel may be worn on a belt. In FIG. 35 it is seen that the attaching means 264 are stitched at the top by stitching 282 and are stitched at the bottom by stitching 284. There is provided a passageway between the stitching 282 and the stitching 284, the attaching means and the back panel 244 of the fishing creel. A belt 286 may be passed through the passageway or the two passageways of the two attaching means so as to position the fishing creel on the belt. The belt 286 comprises a strap 288 having, on one end, a buckle 290 and a catch 292. Then, on the other end there are holes 294. The catch 292 co-acts with the holes 294 so as to position the belt that is in a loop to be worn by an individual. This makes it possible to carry the fishing creel on the side of a person, in front of a person, or in the back of a person by means of the belt.

It is seen that above each attaching means 264, there is a eyelet 296, having a passageway 298. The eyelet 296 makes it possible to attach a belt to the fishing creel by running the belt through passageways 298 of the eyelets and then buckling the belt so as to form a loop. The fishing creel can be worn over the shoulder of a person in this manner.

The screen 256 and a flexible spacing ribs 258 can be integral. Also, the screen 256 and the ribs 258 can be removed from the interior of the fishing creel, dipped in water, and then placed back inside of the fishing creel. If this is done once every three or four hours, on a normal day, the water will evaporate from the screen and also from the ribs so as to keep the interior of the fishing creel cool. The excess water can run out of the bottom of the fishing creel and through the holes 280.

In addition to keeping fish inside of the fishing creel it is possible to keep food, beverages, so as to keep these items cool. Also, it is possible to keep other small items, such as fish hooks, leader, and any other items a backpacker or hiker may carry, in the fishing creel.

Again, the removal of the screen and the ribs from the interior of the fishing creel, dipping them into water and then, placing them back inside the fishing creel, keeps the interior of the fishing creel moist and also allows the excess moisture to evaporate so as to cool the inside of the fishing creel, and to cool the contents of the fishing creel.

FIGS. 38–41 illustrate an adjustable carrying strap 310. This strap 310 comprises a strap portion 312.

There is a connector 314 comprising a middle bar 316, a first end bar 318 and a second end bar 320. The middle bar 316 in the first end bar 318 define a first passageway 322. The middle bar 316 and the second end bar 320 define a second passageway 324. The connector 314 may be made from metal or may be made from plastic.

There is a loop 326, having a passageway 328. The loop 326 may be of metal or may be of plastic.

One end of the strap 312 passes through the first passageway 322, of the connector 314 to define a fixed end 330 wherein the strap 312 is stitched to itself by stitching 332. In effect, the end of the strap 312 is stitched into a loop at stitching 332 with part of the strap being in the first passageway 322, the connector 314.

Then, the strap 312 passes through the passageway 328 of the loop 326. The strap 312 also passes over the fixed end 332 and through the passageway 322 into the connector. With respect to 39 it is seen that the strap 312 passes over the first end bar 318 and through the passageway 322, under the middle bar 316, up and through the second passageway 324 and over the second end bar 320.

With respect to FIG. 39, it is seen that the strap 312 has a free end 334, see the right portion of FIG. 39.

On the upper surface of the strap 312, with respect to 339, and positioned between the connector 314 and the free end 334 there is a first attaching means 336. Also, on the upper surface of the strap 312 and near the free end 334 and between the first attaching means 336 and the free end 334, there is a second attaching means 338.

Now, with respect to FIG. 41, it is possible to form a carrying loop out of the adjustable carrying strap 310 by passing the free end 334 through the loop 326 and then folding the strap back on itself so that the second attaching means 338 is below the first attaching means 336. The attaching means 338 and 336 can be pressed together, to unite the two so as to have the adjustable carrying strap 312 in the form of a loop.

In FIG. 41 there is illustrated an individual 340 having a back pack or roll 342. There are two adjustable carrying straps 310 passing underneath the back pack or roll 342 and over the shoulders of the individual 340. These straps 310 can be so positioned that the straps pass over the shoulders of the individual and underneath the armpits and around the waist of the individual, so as to make it possible to carry the back pack or roll 342.

The first attaching means 336 and the second attaching means 338 make it possible to adjust the length or the loop of the adjustable carrying strap so as to fit individuals of different builds. Some individuals have a long torso and other individuals have a short torso. With the attaching means 336 and 338 it is possible to adjust the straps so that the position of the back pack or roll 342 is comfortable on the individual or person 340.

In FIGS. 42–45 there is illustrated another attaching means. There is a shirt or jacket 348 having a packet or pocket 350. The pocket 350 is integral or attached to the shirt or jacket 348. There is a flap 352 on the pocket 350. On the inner surface of the flap there is a first attaching means 354. There is a strap or suspenders 356. In FIG. 44 it is seen that the shirt or jacket has two spaced apart pockets 350.

In FIGS. 43 and 44 there is a front view of the pocket 350 and a rear view of the pocket 350. In FIGS. 43 and 44 it is seen that there is a pocket 350 and then on the front of the pocket 350 there is an auxiliary pocket 358. On the upper part of the auxiliary pocket 358 there is a zipper 360.

In FIG. 43 it is seen that on the front of the flap 352 there is a first attaching means 354.

In FIG. 44 it is seen that on the back of the flap 352 there is a second attaching means 362.

With a first attaching means on one surface of the flap 352 and a second attaching means on the other surface of the flap 352 it is possible to have an attaching means on the suspenders or strap 356 which can attach to at least the first attaching means with the second attaching means so as to support the suspenders 356.

In FIG. 45 there is illustrated a pocket unit 364. On the back of the pocket unit 364 there are a number of strips of material 366. These strips of material 366 are joined to the pocket unit 364 by stitches 368 so as to form loops 370. The pocket unit 364 can be attached to the suspenders or strap 356 by means of the second attaching means 354 on back of the flap 352 and by first attaching means 372 on the suspenders or strap 256. Also, the suspenders or strap 356 can pass through the loops 370 so as to more definitely position the pocket unit 364.

In FIGS. 46–54 there is illustrated an attaching assembly for attaching a first attaching means to a cloth or a garment.

The attaching assembly is identified by reference numeral 80. There is a garment 382, such as a shirt, jacket, slicker and the like. In the garment 382 there are cut two slots or two cuts 384.

There is a first unit, which is positioned on the inside or the hidden side of the garment 382. The first unit comprises a positioning means 386 having a base 388. In the base 388 there is a first passageway 390. In FIG. 50 it is seen that the passageway 390 has a square or rectangular configuration. The passageway 390 lends flexibility to the base 388. There is positioned on the base 388 two spaced-apart studs 392. On the outer part of each stud 392 there is a circular outer flange 394. The flange 394 may be considered to be a locking flange.

There is a solid foam, flexible plastic 396, which cofits with the passageway 390.

There is a solid foam, flexible plastic 398, having, substantially, the same outer dimensions as the base 388.

The solid, flexible foam plastic 396 and 398 may be one of the commercially available materials, such as foam rubber.

There is a cloth or plastic 400, having a base 402. There is an outer leg 404 and an inner leg 406. In the inner leg 406 there are two spaced-apart holes 408.

As can be, readily, seen the outer leg 404 and the inner leg 406 encompass the positioning means 386, 396 and 398 to form a sandwich construction with the studs 392 projecting through the two spaced-apart holes 408 in the leg 406.

That part of the attaching assembly 380, which is on the outside of the garment 382, comprises a cloth or plastic 410, having a base 412, an inner leg 414 and an outer leg 416. On the outside of the outer leg 416 there is a first attaching means 418. The first attaching means 418 is connected to 416 by stitches 420. The first attaching means 418 is exposed and visible.

There is a locking plate 422 having two spaced-apart passageways 424. On the outer surface of locking plate 422 and surrounding each of the passageways 424 is a circular housing 426. In the interior of the circular housing 426 there is an inner circular recess 428. The inner circular recess 428 receives the circular outer flange 394 so as to lock this flange in the locking plate 422. The two studs 392 project into the passageways 424 and are locked into position by means of the circular outer flange 394 and the inner circular recess 428. The locking plate 422 may be of plastic or metal.

In the central portion of the locking plate 422 there is a passageway 430 of a square or rectangular configuration. The passageway 430 lends flexibility to the locking plate 422.

There may be positioned in the passageway 430 a solid foam, flexible plastic 432. On the inner surface of the locking plate 422 there may be positioned a solid foam, flexible plastic base 434 having two spaced-apart holes 436. The solid foam, flexible plastic 432 and the base 434 may be foam rubber.

It is seen that in the inner leg 414 of the cloth or plastic 410, there are two spaced-apart holes 438.

On the outer surface of the locking plate 422 there is positioned a solid foam, flexible plastic 440 having two spaced-apart holes 442. The plastic 440 may be foam rubber.

The holes 438 are aligned with the holes 436, which are aligned with the passageways 424, which are aligned with the holes 442.

The components 382–408 may be formed into an integral unit by means of adhesive. Adhesive may connect the outer leg 404 with the solid foam, flexible plastic 398. Then, 398 may be connected with the base 388. The two studs 392 project through the two spaced-apart holes 408. The base 388 may be connected with an adhesive to the inner leg 406.

The components 410–444 can be connected into an integral unit by means of adhesive. The inner leg 414 may be connected to the base 434 by means of adhesive, the base 434 may be connected to the locking plate 422 by means of an adhesive and the locking plate 422 can be connected to the solid flexible foam plastic 440 by means of an adhesive. Likewise, the outer leg 416 can be connected to the solid foam plastic 440 by means of an adhesive. The result is an integral unit of the components 410–442.

The result is that the integral inner components 382–408 can be carried as a unit, along with the integral outer components 410–442, which can be carried as an integral unit.

In use, two slots 384 can be cut into the garment 382. Then, on the inner part of the garment 382 the two studs 392 can be projected through the two slots 384. On the outer part of the garment there is positioned the integral components 410–442. The two studs 392 project through the two slots or cuts 384 and through the holes 438, 436 and into the passageway 424. The locking plate 422 is snapped over the two studs 392 so that the circular outer flanges 394 are positioned in the inner circular recesses 428 so that the studs are locked into the locking plate 422. The outer ends of the studs 392 project into the holes 442 of the solid foam, flexible plastic 440. In other words, the outer components are firmly attached on the outside of the garment 382 with the first attaching means 418 exposed to receive a second attaching means on a suitable material, such as a strap or other garments or the like, or a bag or roll or pack.

In FIG. 54 there is a cross-sectional view illustrating these components in the assembled state and with the first attaching means positioned to receive the second attaching means on a suitable article.

In FIG. 51 there is a front view of the attaching assembly 380, illustrating the first attaching means 418 on the outer part of the garment.

In FIG. 52 there is illustrated a rear view of the part of the attaching means on the outside of the garment, and which view is taken from looking from the inner leg 414 towards a first attaching means 418.

In FIG. 53 there is a view of the attaching means 380 and which view is taken from the inner part of the locking plate 422 and looking towards the first attaching means 418.

In FIG. 46 there is a fragmentary view looking at the garment 382 and showing the locking plate 422 positioned over the studs 392. In this view the plastic or cloth 410, the solid foam plastic 440, the outer leg 416 and the first attaching means 418 are not illustrated.

In FIG. 47, taken on line 47—47 of FIG. 46, there is illustrated the partial construction of the attaching assembly 380 and there is illustrated, in particular, the positioning means 386, the base 388, the inner leg 406, the garment 382, and the locking plate 422.

In FIG. 48 there is illustrated the attaching assembly 380 on the outside of the garment 382 and there is seen, in phantom, the spaced-apart holes 436 and also, there is illustrated the first attaching means 418.

In FIG. 49 a person is looking from the inside of the garment towards the outside and there is illustrated the two spaced-apart holes 436, in phantom, and there is also shown the leg 404.

From the FIGS. 46–54 and also from the description for these FIGURES, it is seen that I have provided a means for converting a shirt, a jacket, a slicker or other article of clothing for supporting a back pack, a roll, a bag or the like. This is accomplished by placing a first fastening means, definitely positioning said first fastening means on said garment by cutting two holes in the garment and then placing on the inside of the garment and on the outside of the garment, locking components to lock the first attaching means to the garment. Then, an article such as strap or a pack or a roll or the like can be attached by means of a second attaching means to the first attaching means on the outer part of the garment. In this manner, it is not necessary to have a separate pack board or a separate pack frame as the garment itself can be used for supporting the pack or roll and the like. The result is, that there is a saving in weight, of a few pounds. At the end of a hike or at the end of a walk the saving in weight of a few pounds can be, pleasantly, noticeable. Also, there is eliminated the necessity of buying a pack board or a pack frame, which means there is less expense involved in a person going hiking or back packing.

The attaching means comprises a first member and a second member. There members interact to bond themselves together into an integral unit. These members, releasably, connect together.

There are many teachings of such attaching means, comprising a first member and a second member bonding themselves together. For example, there are U.S. Pat. Nos. 3,387,345; 3,154,837; 3,147,528; 3,130,111; and, 3,009,235. These patents teach of a, generally, similar structure. This structure comprises on one of the members a loop and on the other member a hook. By pressing together the loop and the hook there is bonded together the first member and the second member. It is possible, by pulling on these two members, to separate these two members. However, without a definite, and sometimes, strong pull the two members do not separate.

There is U.S. Pat. No. 3,076,244 comprising two loops which hook together and may be considered to be hooking members. On the first member there is a series of loops. On the second member there is a series of loops. By pressing together the first member and the second member the loops intertwine so as to make the first member and the second member integral. Again, by pulling on the first member and the second member it is possible to separate the two members from each other.

Another attaching means is described in U.S. Pat. No. 3,192,589 which teaches of a number of headed stubs. The first member comprises headed stubs on a flexible base and the second member comprises headed stubs on a flexible base. By pressing together the first member and the second member the headed stubs intertwine and make integral the first member and the second member. Again, it is possible, by pulling on the first member and the second member, to separate the two members.

With my invention, it is possible to attach a first member to an article of clothing or to the article to be carried. Likewise, it is possible to attach the second member to the article to be carried or to the article of clothing. By pressing together the first member and the second member, the article of clothing supports the article to be carried. In this manner, there is eliminated the necessity for a pack board or a back pack. The article of clothing has been converted into an auxilliary use, simultaneously, with its use as an article of clothing by using the article of clothing as a support for an article to be carried. In essence, the article of clothing has also become a back pack or a pack board.

Prior to preparing this patent application, a Patent Search was made. The following Patents were disclosed by the Patent Search:

| U.S. Pat. No. | PATENTEE |
|---|---|
| 157,537 | Palmer |
| 202,663 | Palmer |
| 1,635,928 | Davis |
| 1,650,491 | Calvert |
| 2,018,606 | Cumings |
| 2,461,526 | Cull et al |
| 4,033,488 | Brewer |

I consider my invention to be new, as I do not know of a similar pouch and fishing creel construction. With my fishing creel it is possible to have a support for fish, or other food items and also to keep the interior of the fishing creel the fish or other food items cool. Also, I do not know of another connecting strap like the connecting strap I have made for carrying an article of clothing. Further, I do not know of another teaching of a support means for attaching to or projecting through an article of clothing so as to be able to support an item to be carried.

I consider my invention to be useful, as it is possible to have an article of clothing function, simultaneously, as a back pack or pack board for an item to be carried. In other words, the article of clothing serves two purposes, viz., as an article of clothing and also as a support for a back pack or pack board.

I consider my invention to be unobvious, as I know of no other prior teaching of such a pouch, which can be used as a fishing creel; a connecting strap constructed in accordance with my teaching; and, a support means which can be attached to an article of clothing.

Having presented my invention, what I claim is:

1. A combination of a pouch and a support, said combination comprising:

a. said pouch having a cavity for receiving an item and an opening to said cavity;

b. said support being an article of clothing; and, c. a first means for attaching said pouch to said support;

d. said first means for attaching said pouch to said support comprising a base member, a first arm and a second arm;

e. said first arm and said second arm being capable of projecting through the fabric of said article of clothing to attach said base to said article of clothing;

f. a first reinforcing plate for positioning on the outside of said support;

g. a second reinforcing plate for positioning on the inside of said support;

h. said first arm and said second arm passing through said reinforcing plate and through said reinforcing plate and bending to attach said base to said support;

i. said first arm and said second arm being capable of being removed from said first reinforcing plate and from said second reinforcing plate and from said support to allow said support and said first means to be separated;

j. said first arm and said second arm being flexible and being capable of being bent; and, k. a first attaching means on said base member and a second attaching means on said pouch for allowing said pouch to be releasably attached to said first attaching means on said base member.

2. A combination of a pouch and a support accoring to claim 1 comprising:

a. said pouch having a cover flap for covering said opening to said cavity.

3. A combination of a pouch and a support according to claim 1 comprising:

a. passageways in said article of clothing;

b. said pouch having a cover flap for covering said opening to said cavity;

c. a first attaching means on said pouch and a second attaching means on said cover flap;

d. said first attaching means on said pouch and said second attaching means on said cover flap allowing said cover flap to releasably cover said opening to said cavity; and, e. said first arm and said second arm protecting through said passageways to attach said base to said article of clothing.

4. A combination of a pouch and a support according to claim 3 comprising:

a. a first attaching means on said base member and a second attaching means on said pouch for allowing said pouch to be releasably attached to said first attaching means on said base member.

5. A combination of a pouch and a support according to claim 4 comprising:

a. a first attaching means on said pouch and juxtapositioned to said opening and a second attaching means on cover flap allowing said cover flap to said second attaching means releasably connect with said first attaching means on said pouch to cover said opening to said cavity.

6. A combination of a pouch and a support according to claim 5 comprising:

a. said first attaching means and said second attaching means comprising a plurality of interconnecting members for allowing releasable fastening together of said first attaching means and said second attaching means; and, b. said interconnecting members being flexible and yeildable to accommodate each other and to intertwine with each other and to form a releasable bond with each other.

7. A combination of a pouch and a support according to claim 4 comprising:

a. said first arm and said second arm being flexible and being capable of being bent;

b. an inside reinforcing plate for cooperating with said arms and being on the inside of said garment; and, c. an outside reinfocing plate for cooperating with said base and said arms and being on the outside of said garment.

8. A combination of a pouch and a support according to claim 3 comprising:

a. strap, operatively, connecting with said pouch; and, b. a first attaching means on said base member and a second attaching means on said strap for allowing said pouch to be releasably attached to said first attachable means on said base member.

9. A combination of a pouch and a support according to claim 8 comprising:

a. said first attaching means and said second attaching means comprising a plurality of interconnecting members for allowing releaseable fastening together of said first attaching means and said second attaching means; and, b. said interconnecting members being flexible and yieldable to accommodate each other and to intertwine with each other and to form a releasable bond with each other.

10. A combination of a pouch and a support according to claim 1 comprising:

a. inside of said pouch and in said cavity a number of ribs to space apart an object in said pouch from said pouch.

11. A combination of a pouch and a support according to claim 1 comprising:

a. said pouch having sides;

b. inside of said pouch and in said cavity a number of ribs adjacent to said sides to space apart an object in said pouch from said sides; and, c. an opening in a side to allow circulation of a gas in and out of said pouch.

12. A combination of a pouch and a support according to claim 11 comprising:

a. said pouch having a cover flap for covering said opening to said cavity;

b. an opening in said cover flap to allow ingress and egress of an object with respect to the cavity of said pouch without moving the cover flap from the opening to said cavity.

13. A combination of a pouch and a support according to claim 12 comprising: 'a. said pouch having sides;

b. inside of said pouch and in said cavity a number of ribs adjacent to said sides to space apart an object in said pouch form said sides;

c. an opening in a side to allow circulation of a gas in and out of said pouch; and, d. a screen inside of said pouch to assist in positioning an object inside of said pouch from the sides of said pouch and to assist in the circulation of said gas in and out of said pouch.

14. A combination of a pouch and a support according to claim 13 comprising:

a. a strap, operatively, connecting with said pouch;

b. said support being a body garment;

c. a first attaching means on said strap;

d. a second attaching means on said body garment; and, e. said first attaching means and said second attaching means are capable of being releasably interconnected.

15. A combination of a pouch and a support according to claim 14 comprising:

a. a first attaching means on said pouch and a second attaching means on said cover flap; and, b. said first attaching means and said second attaching means allowing said cover flap to releasably cover said opening to said cavity.

16. A combination of a pouch and a support according to claim 15 comprising:

a. said first attaching means and said second attaching means comprising a plurality of interconnecting members for allowing releasable fastening together of said first attaching means and said second attaching means.

17. A combination of an article of clothing and a support means:

a. said article of clothing having a passageway; said support means comprising:

b. an inner part and an outer part;

c. said inner part comprising a base and a stud projecting outwardly from said base and for prjecting through said passageway;

d. said inner part comprising a flexible member on the outside of said base with said base being between said article of clothing and said flexible member;

e. a cover means having a passageway for receiving said stud;

f. said cover means being on the outside of said base and said flexible members;

g. said outer part comprising a locking plate having a receiving means for receiving said member projecting outwardly from said base; and, h. operatively connecting with said outer part, a first attaching means;

i. said outer part comprising a flexible base having a passageway for receiving said stud and being positioned between said base and said locking plate;

j. a flexible member having a passageway for receiving said stud and being positioned outside of said locking plate and with said locking plate being between this flexible member and said base;

k. a cover means having a passageway for receiving said stud and being on the outside of the flexible members of said outer part;

l. said inner part being on one side of said article of clothing with said member projecting through said passageway in said article of clothing; and, M. said outer part being on the other side of said article of clothing with said member being in said receiving means in said locking plate.

18. A combination according to claim 17 and comprising:

h. said inner part comprising said base and members projecting outwardly from said base; and, i. said outer part comprising a locking plate having a receiving means for receiving said members projecting outwardly from said base.

19. A combination according to claim 17 n. a second attaching means operatively connecting with an object to be supported;

o. said first attaching means and said second attaching means comprising a plurality of interconnecting members for allowing releaseable fastening together of said first attaching means and said second attaching means; and, p. said interconnecting members being flexible and yieldable to accommodate each other and to intertwine with each other and to form a releasable bond with each other.

20. A combination according to claim 18 and comprising:

j. a second attaching means operatively connecting with an object to be supported;

k. said first attaching means and said second attaching means comprising a plurality of interconnecting members for allowing releasable fastening together of said first attaching means and said second attaching means; and, l. said interconnecting members being flexible and yieldable to accommodate each other and to intertwine with each other and to form a releasable bond with each other.

* * * * *